US007094511B2

(12) United States Patent
Yamada et al.

(10) Patent No.: US 7,094,511 B2
(45) Date of Patent: Aug. 22, 2006

(54) ELECTROPHOTOGRAPHIC PHOTORECEPTOR, METHOD FOR PRODUCING THE SAME, IMAGE FORMING APPARATUS AND PROCESS CARTRIDGE

(75) Inventors: Wataru Yamada, Kanagawa (JP); Katsumi Nukada, Kanagawa (JP); Kazuhiro Koseki, Kanagawa (JP); Masahiro Iwasaki, Kanagawa (JP); Takayuki Yamashita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/669,719

(22) Filed: Sep. 25, 2003

(65) Prior Publication Data

US 2004/0197690 A1 Oct. 7, 2004

(30) Foreign Application Priority Data

Mar. 24, 2003 (JP) ..... 2003-081472

(51) Int. Cl.
*G03G 5/05* (2006.01)

(52) U.S. Cl. ..... 430/96; 430/58.15; 430/58.2; 430/58.7; 430/66; 430/127; 399/116; 399/159

(58) Field of Classification Search ..... 430/58.15, 430/58.2, 58.7, 96, 56, 127, 132, 66; 399/116, 399/159

See application file for complete search history.

(56) References Cited

U.S. PATENT DOCUMENTS 6,479,202 B1 * 11/2002 Shida et al. ..... 430/58.2
2004/0086794 A1 * 5/2004 Yamada et al. ..... 430/56

FOREIGN PATENT DOCUMENTS

JP A 2000-275886 10/2000
JP 2001-100447 * 5/2001

OTHER PUBLICATIONS

Japanese Patent Office machine-assisted English-language translation of JP 2001-100447 (pub. Apr. 2001).*
THOMAS machine-assisted translation of JP 2001-100447 (pub. Apr. 2001).*

* cited by examiner

*Primary Examiner*—Janis L. Dote
(74) *Attorney, Agent, or Firm*—Oliff & Berridge, PLC

(57) ABSTRACT

The present invention relates to an electrophotographic photoreceptor comprising a conductive support having formed thereon a specific photosensitive layer. The photosensitive layer comprises a siloxane resin-containing layer containing a siloxane resin having a structural unit represented by general formula (1) shown below, a structural unit represented by general formula (2) shown below, and an organic group derived from a compound having hole transport capability, or comprises a siloxane resin-containing layer containing a siloxane resin obtained by using an organic silicon compound having a structural unit represented by general formula (1) shown below and a hydrolytic group, and a compound represented by general formula (3) shown below:

(1)

(2)

(3)

The formulas are defined in the specification.

10 Claims, 4 Drawing Sheets

ELECTROPHOTOGRAPHIC PHOTORECEPTOR, METHOD FOR PRODUCING THE SAME, IMAGE FORMING APPARATUS AND PROCESS CARTRIDGE

FILED OF THE INVENTION

The present invention relates to an electrophotographic photoreceptor and a method for producing the same. The invention also relates to an image forming apparatus and a process cartridge.

RELATED ART OF THE INVENTION

In image forming apparatus such as copiers, printers and facsimiles, electrophotographic systems in which charging, exposure, development, transfer, etc. are carried out using electrophotographic photoreceptors have been widely employed. In such image forming apparatus, demands for speeding up of image formation processes, improvement in image quality, miniaturization and prolonged life of the apparatus, reduction in production cost and running cost, etc. are increasingly growing. Further, with recent advances in computers and communication technology, digital systems and color image output systems have been applied also to the image forming apparatus.

In view of such a background, improvement in electrophotographic properties and durability, reduction in cost, miniaturization, etc. in electrophotographic photoreceptors have been studied. In particular, since a function separation type photoreceptor in which the charge generation function and the charge transfer function were separated from each other was proposed, various organic functional materials have been developed taking advantage of ease of designing organic matter, and electrophotographic photoreceptors using various organic materials have been developed.

For example, Patent Document 1 discloses that a surface layer of an electrophotographic photoreceptor is allowed to contain a siloxane-based cured resin containing a specified structural unit in order to improve durability.

Patent Document 1: JP-A-2000-275886 (The term "JP-A" as used herein means an "unexamined published Japanese patent application".)

However, even the above-mentioned conventional electrophotographic photoreceptor is not necessarily sufficient in electrophotographic characteristics and durability, particularly when it is used in combination with a charger of the contact charging system (contact charger) or a cleaning apparatus such as a cleaning blade.

Further, when the photoreceptor is used in combination with the contact charger and a toner obtained by chemical polymerization (polymerization toner), the surface of the photoreceptor is stained with a discharge product produced in contact charging or the polymerization toner remaining after a transfer step to deteriorate image quality in some cases.

Furthermore, in producing the electrophotographic photoreceptor, in addition to improvement in electrophotographic characteristics and durability, it becomes an important problem to reduce production cost. However, in the case of the conventional electrophotographic photoreceptor, the problem is encountered that coating defects such as orange peel appearances and hard spots are liable to occur.

SUMMARY OF THE INVENTION

The invention has been made in view of the problems of the above-mentioned related art.

Accordingly, an object of the invention is to provide an electrophotographic photoreceptor which is sufficiently high in stain resistance against a developing agent, a discharge gas, a discharge product, etc. and in durability against a contact charger, a cleaning blade, etc.

Another object of the invention is to provide a method for producing the same.

A still other object of the invention is to provide an image forming apparatus and a process cartridge which can provide good image quality for a long period of time.

Other objects and effects of the invention will become apparent from the following descriptions.

In order to achieve the above-mentioned objects, the present inventors conducted extensive studies. As a result, the inventors discovered that in an electrophotographic photoreceptor in which a siloxane cured resin containing a conventional specified structural unit is used in its surface layer, structural units constituting the resin do not sufficiently react with each other, resulting in low crosslinking density to cause insufficient durability. As a result of further studies based on such information, the inventors discovered that it becomes possible to improve the stain resistance against the developing agent, the discharge gas, the discharge product, etc. and the durability against the contact charger, the cleaning blade, etc. by providing the photosensitive layer with a siloxane cured resin-containing layer containing a siloxane resin having two kinds of specified structural units and a specified organic group, thus completing the invention.

That is, the electrophotographic photoreceptor of the invention comprises a conductive support having formed thereon a photosensitive layer, wherein the photosensitive layer comprises a siloxane resin-containing layer containing a siloxane resin having a structural unit represented by general formula (1) shown below, a structural unit represented by general formula (2) shown below, and an organic group derived from a compound having hole transport capability:

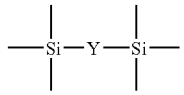

(1)

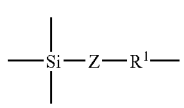

(2)

wherein, in formula (1), Y represents a divalent group, and in formula (2), $R^1$ represents an alkylene group, and Z represents an oxygen atom, a sulfur atom or NH.

The siloxane resin contained in the siloxane resin-containing layer constituting the photosensitive layer may be obtained by using an organic silicon compound having a structural unit represented by the above-mentioned general formula (1) and a hydrolytic group, and a compound represented by the following general formula (3).

$$F^1\text{-}(R^1\text{-}ZH)_h \quad (3)$$

wherein $F^1$ represents an organic group derived from a compound having hole transport capability, $R^1$ represents an alkylene group, Z represents an oxygen atom, a sulfur atom or NH, and h represents an integer of 1 to 4.

In the above-mentioned electrophotographic photo-receptors of the invention, the organic group derived from a compound having hole transport capability is preferably an organic group represented by the following general formula (4):

(4)

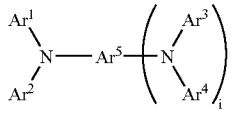

wherein $Ar^1$, $Ar^2$, $Ar^3$ and $Ar^4$, which may be the same or different, each represents a substituted or unsubstituted aryl group, $Ar^5$ represents a substituted or unsubstituted, aryl or arylene group, i represents 0 or 1, and at least one of $Ar^1$ to $Ar^5$ has a bonding hand with $R^1$ in the above-mentioned general formula (2) or (3).

The method for producing the electrophotographic photoreceptor of the invention is a method for producing an electrophotographic photoreceptor comprising a conductive support having formed thereon a photosensitive layer containing a siloxane resin-containing layer, which comprises:

a coating solution preparing step of preparing a coating solution for formation of a siloxane resin-containing layer using an organic silicon compound having a structural unit represented by the above-mentioned general formula (1) and a hydrolytic group, and a compound represented by the above-mentioned general formula (3); and a siloxane resin-containing layer forming step of forming the siloxane resin-containing layer using the coating solution.

In the method for producing the electrophotographic photoreceptor of the invention, it is preferred that the coating solution contains at least one of a metal chelate compound and a multidentate ligand.

Further, the image forming apparatus of the invention comprises:

the above-mentioned electrophotographic photo-receptor of the invention;

a charging device for charging the electrophotographic photoreceptor;

an exposing device for exposing the charged electrophotographic photoreceptor to form an electrostatic latent image;

a developing device for developing the electrostatic latent image to form a toner image; and a transfer device for transferring the toner image to a medium to which the toner image is to be transferred.

Furthermore, the process cartridge of the invention comprises:

the above-mentioned electrophotographic photo receptor of the invention; and at least one member selected from the group consisting of a charging device for charging the electrophotographic photoreceptor, an exposing device for exposing the electrophotographic photoreceptor after the charging to form an electrostatic latent image, and a cleaning device for cleaning the electrophotographic photoreceptor after the exposure.

The image forming apparatus and process cartridge which can provide good image quality for a long period of time can be realized by using the electrophotographic photoreceptor of the invention as described above.

DETAILED DESCRIPTION OF THE INVENTION

Figure 1:
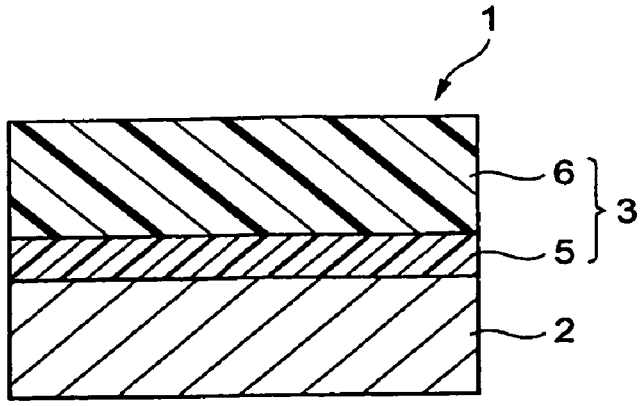
FIG. 1 is a schematic cross sectional view showing a preferred embodiment of an electrophotographic photoreceptor of the invention.

Preferred embodiments of the invention will be described in detail below with reference to drawings in some cases. In the drawings, the same reference numerals and signs are used to designate the same elements, and repeated descriptions are avoided.

Electrophotographic Photoreceptor

In the electrophotographic photoreceptor of the invention, the photosensitive layer thereof comprises a siloxane resin-containing layer containing a siloxane resin described below.

First, the siloxane resin will be described. The siloxane resin is a resin having a structural unit represented by general formula (1) shown below, a structural unit represented by general formula (2) shown below, and an organic group derived from a compound having hole transport capability.

(1)

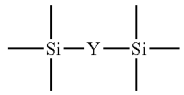

(2)

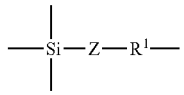

In formula (1), Y represents a divalent group, and in formula (2), $R^1$ represents an alkylene group, and Z represents an oxygen atom, a sulfur atom or NH.

The silicon atom (Si) to which the group represented by $-Z-R^1-$ binds in the above-mentioned formula (2) may be either Si in the above-mentioned formula (1) or Si other than that. Accordingly, the siloxane resin according to the invention can have a structural unit represented by the following general formula (5):

(5)

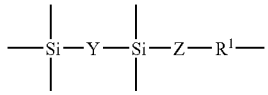

wherein Y represents a divalent group, $R^1$ represents an alkylene group, and Z represents an oxygen atom, a sulfur atom or NH.

Further, the siloxane resin according to the invention may have a structural formula represented by the following general formula (6):

(6)

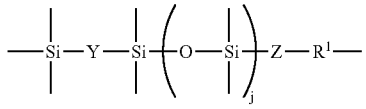

wherein Y represents a divalent group, $R^1$ represents an alkylene group, Z represents an oxygen atom, a sulfur atom or NH, and j represents an integer of 1 or more.

In the above-mentioned formulas (1), (5) and (6), the divalent group represented by Y may be any as long as it is a divalent group containing at least one carbon atom in its main chain, and preferably comprises a $—C_nH_{2n}—$, $—C_nH_{2n-2}—$, $—C_nH_{2n-4}—$ (n is an integer of 1 to 15, and more preferably an integer of 2 to 10), a divalent hydrocarbon group represented by $—C_6H_4—$ or $—C_6H_4—C_6H_4—$, a divalent group represented by —NH— or $—C_nF_{2n}—$ (n is an integer of 1 to 15, and more preferably an integer of 2 to 10), an oxycarbonyl group (—COO—), a thio group (—S—), an oxy group (—O—), an isocyano group (—N═CH—), or a divalent group obtained as a combination of two or more of them. More specifically, when a divalent group containing no carbon atom such as the above-enumerated thio group or oxy group is used for Y, such a group is used in combination with a group containing a carbon atom to constitute a divalent group containing at least one carbon atom in its main chain. The divalent group may have a substituent group such as an alkyl group, a phenyl group, an alkoxyl group or an amino group on its side chain. When Y is the above-mentioned preferred divalent group, moderate flexibility tends to be imparted to the resulting resin to improve the strength of the layer.

In the above-mentioned formulas (2), (5) and (6), it is preferred that the alkylene group represented by $R^1$ has 1 to 20 carbon atoms. When the alkylene group has carbon atoms within the above-mentioned range, the compatibility of the siloxane resin in the coating solution can be improved.

Further, there is no particular limitation on the above-mentioned organic group derived from the compound having hole transport capability, which is contained in the siloxane resin, as long as it is an organic group derived from a compound having hole transport capability. However, the organic group is preferably an organic group represented by the following general formula (4):

(4)

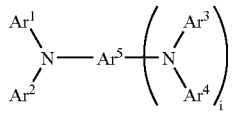

wherein $Ar^1$, $Ar^2$, $Ar^3$ and $Ar^4$, which may be the same or different, each represents a substituted or unsubstituted aryl group, $Ar^5$ represents a substituted or unsubstituted, aryl or arylene group, i represents 0 or 1, and at least one of $Ar^1$ to $Ar^5$ has a bonding hand with $R^1$ of the above-mentioned general formula (2) or (3).

$Ar^1$ to $Ar^4$ in the above-mentioned formula (4) are each preferably a group represented by any one of the following general formulas (7) to (13):

(7)

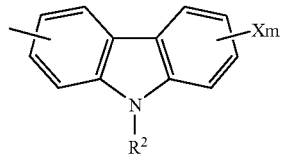

(8)

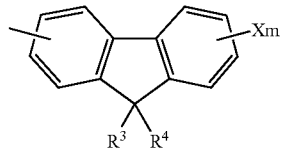

(9)

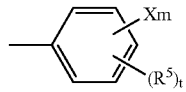

(10)

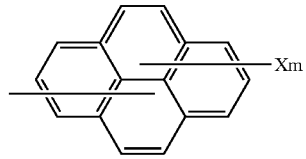

(11)

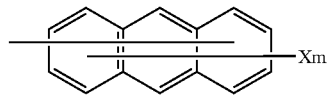

(12)

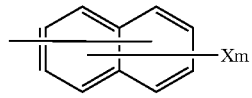

(13)

$—Ar—Z'_s—Ar—X_m$

In formulas (7) to (13), $R^2$ represents one selected from the group consisting of a hydrogen atom, an alkyl group having 1 to 4 carbon atoms, an unsubstituted phenyl group or a phenyl group substituted by an alkyl group having 1 to 4 carbon atoms or an alkoxyl group having 1 to 4 carbon atoms, and an aralkyl group having 7 to 10 carbon atoms; $R^3$ to $R^5$ each represents one selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; Ar represents a substituted or unsubstituted arylene group, X represents —$R^1$-ZH as defined in general formula (3); m and s each represents 0 or 1; and t represents an integer of 1 to 3.

Ar in formula (12) is preferably a group represented by the following formula (13) or (14);

(14)

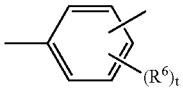

(15)

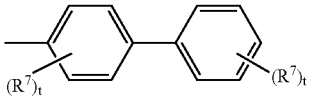

In formulas (14) and (15), $R^6$ and $R^7$ each represents one selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; and t represents an integer of 1 to 3.

Further, Z' in formula (13) is preferably a group represented by any one of the following formulas (16) to (23):

(16) —$(CH_2)_q$—

(17) —$(CH_2CH_2O)_r$—

(18)

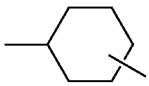

(19)

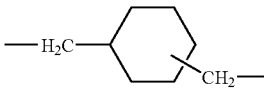

(20)

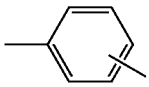

(21)

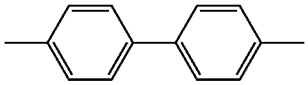

(22)

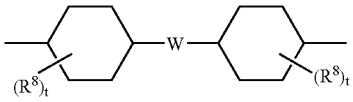

(23)

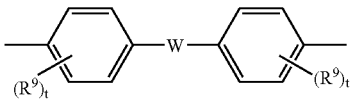

In formulas (16) to (23), $R^8$ and $R^9$ each represents one selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; W represents a divalent group; q and r each represents an integer of 1 to 10; and t represents an integer of 1 to 3.

W in the above-mentioned formulas (22) and (23) is preferably any one of divalent groups represented by the following formulas (24) to (32):

(24) —$CH_2$—

(25) —$C(CH_3)_2$—

(26) —O—

(27) —S—

(28) —$C(CF_3)_2$—

(29) —$Si(CH_3)_2$—

(30)

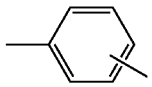

(31)

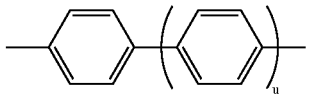

(32)

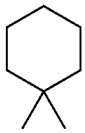

In formula (31), u represents an integer of 0 to 3.

Further, in the above-mentioned formula (4), $Ar^5$ is the aryl group illustrated in the description of $Ar^1$ to $Ar^4$, when k is 0, and an arylene group obtained by removing a predetermined hydrogen atom from such an aryl group, when k is 1.

The above-mentioned siloxane resin can be obtained by using the organic silicon compound having the structural unit represented by the above-mentioned general formula (1) and a hydrolytic group (hereinafter referred to simply as the "organic silicon compound" depending on the circumstances), and the compound represented by the following general formula (3):

$$F^1\text{-}(R^1\text{-}ZH)_h \quad (3)$$

wherein $F^1$ represents an organic group derived from a compound having hole transport capability (having the same meaning as given for the organic group derived from the compound having hole transport capability described above), $R^1$ represents an alkylene group (preferably an alkylene group having 1 to 20 carbon atoms), Z represents an oxygen atom, a sulfur atom or NH, and h represents an integer of 1 to 4.

In this case, a structural unit represented by the following general formula (2a) is formed in the siloxane resin:

(2a)

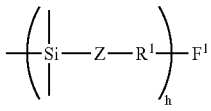

wherein $F^1$ represents an organic group derived from a compound having hole transport capability, $R^1$ represents an alkylene group, Z represents an oxygen atom, a sulfur atom or NH, and h represents an integer of 1 to 4.

The above-mentioned hydrolytic group of the organic silicon compound as used herein means a functional group which can form a siloxane bond (O—Si—O) or a functional group which can form a silanol group (Si—OH) by condensation reaction. Preferred specific examples of such hydrolytic groups include a hydroxyl group, an alkoxyl group, a methyl ethyl ketoxime group, a diethylamino group, an acetoxy group, a propenoxy group and a chloro group. Of these, a group represented by —OR" (R" is an alkyl group having 1 to 15 carbon atoms or a trimethylsilyl group) is preferred.

The organic silicon compound is preferably a compound represented by the following general formula (I):

$$Y—(Si(R^{10})_{(3-a)}Q_a)_2 \quad (I)$$

wherein Y represents a divalent group (having the same meaning as given for Y in formula (1)), $R^{10}$ represents a hydrogen atom, an alkyl group or a substituted or unsubstituted aryl group, Q represents a hydrolytic group, and a represents an integer of 1 to 3.

Further, of the compounds represented by formula (I), the use of the compound in which a=3 can provide higher strength. On the other hand, the use of the compound in which a≦2 can impart flexibility to the siloxane resin-containing layer, and can further stabilize image characteristics under the circumstances of high temperature and humidity. Furthermore, the compound in which Y contains a fluorine atom is preferred in terms of cleaning characteristics and transfer characteristics.

Although there is no particular limitation on the compound represented by formula (I), preferred specific examples thereof include compounds shown in Table 1.

TABLE 1

| No. | Structural Formula |
|---|---|
| (I-1) | $(MeO)_3Si—(CH_2)_2—Si(OMe)_3$ |
| (I-2) | $(MeO)_2MeSi—(CH_2)_2—SiMe(OMe)_2$ |
| (I-3) | $(MeO)_2MeSi—(CH_2)_6—SiMe(OMe)_2$ |
| (I-4) | $(MeO)_3Si—(CH_2)_6—Si(OMe)_3$ |
| (I-5) | $(EtO)_3Si—(CH_2)_5—Si(OEt)_3$ |
| (I-6) | $(MeO)_2MeSi—(CH_2)_{10}—SiMe(OMe)_2$ |
| (I-7) | $(MeO)_3Si—(CH_2)_3—NH—(CH_2)_3—Si(OMe)_3$ |
| (I-8) | $(MeO)_3Si—(CH_2)_3—NH—(CH_2)_2—NH—(CH_2)_3—Si(OMe)_3$ |
| (I-9) | 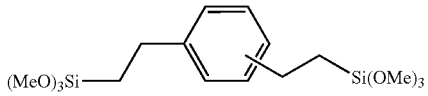 |
| (I-10) | 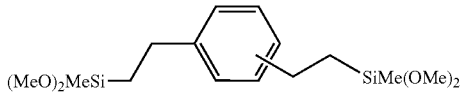 |
| (I-11) | 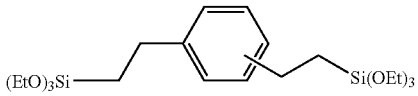 |
| (I-12) | 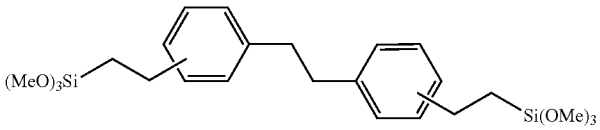 |
| (I-13) | 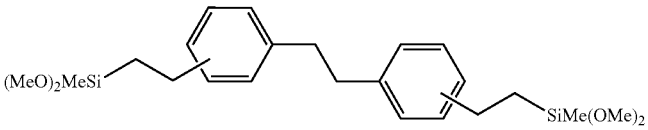 |
| (I-14) | 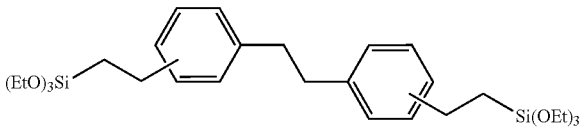 |
| (I-15) | $(MeO)_3SiC_3H_6—O—CH_2CH\{—O—C_3H_6Si(OMe)_3\}—CH_2\{—O—C_3H_6Si(OMe)_3\}$ |
| (I-16) | $(MeO)_3SiC_2H_4—SiMe_2—O—SiMe_2—O—SiMe_2—C_2H_4Si(OMe)_3$ |
| (I-17) | $(MeO)_2MeSiC_2H_4—(CF_2)_6—C_2H_4SiMe(OMe)_2$ |

The compound represented by general formula (3) will be described below. In the above-mentioned general formula (3), the organic group $F^1$ has the same meaning as given for $F^1$ in the above-mentioned formula (2). Further, Z represents an oxygen atom, a sulfur atom or NH as described above. In other wards, Z is a residue in which one hydrogen atom is removed from a hydroxyl group (—OH), a thiol group (or mercapto group, —SH) or an amino group (—$NH_2$).

The compound represented by the above-mentioned formula (3) can be produced at low cost by known methods. In particular, the compound in which Z is an oxygen atom is excellent in characteristics and can be easily produced at low cost, so that it is very preferred. The compound in which Z is an oxygen atom can be synthesized by various methods, for example, reactions represented by the following formulas (33) and (34):

(33)

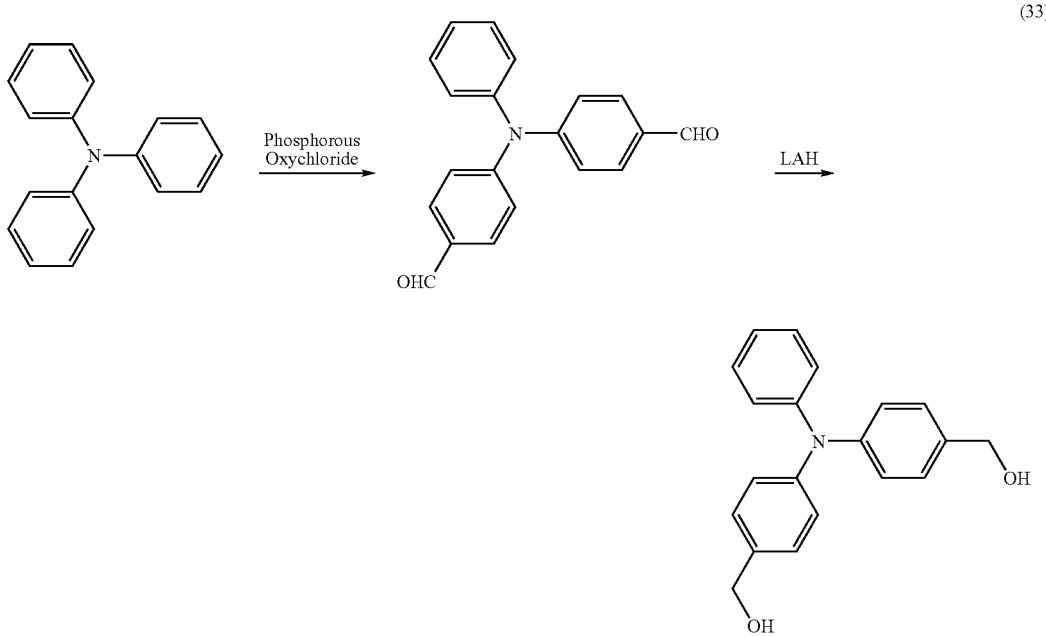

(34)

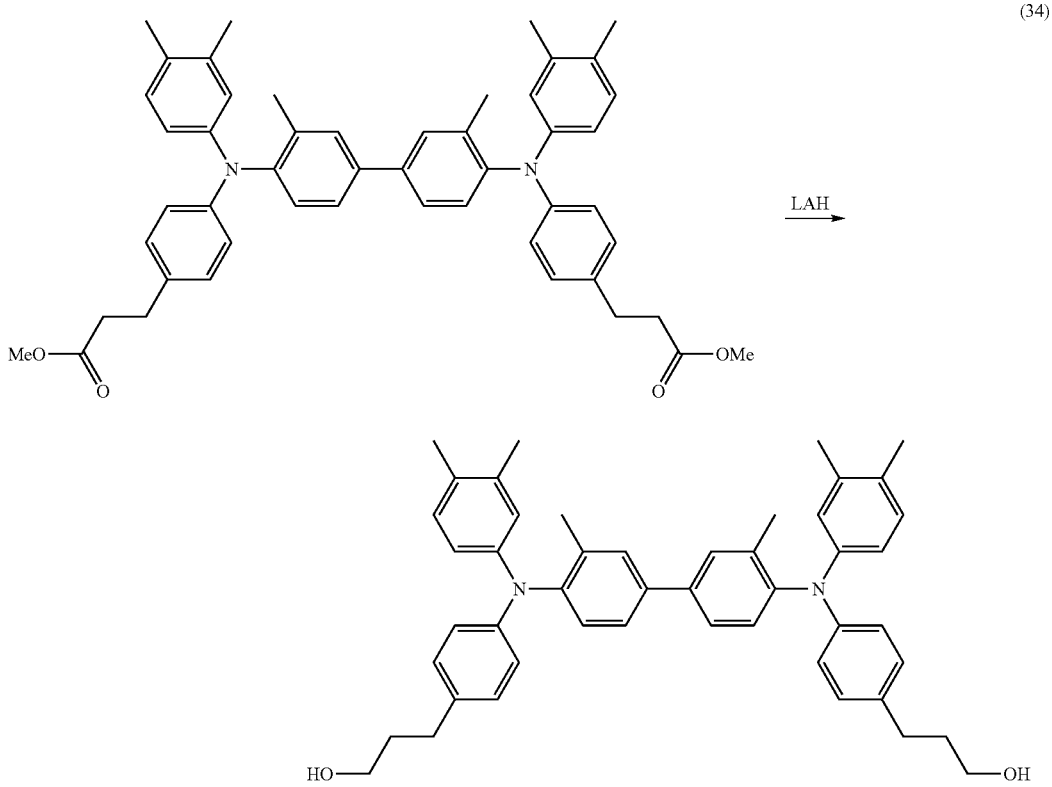

Although there is no particular limitation on the compound represented by general formula (3), specific examples thereof include compounds represented by the following formulas (3-1) to (3-16):
(3-1)
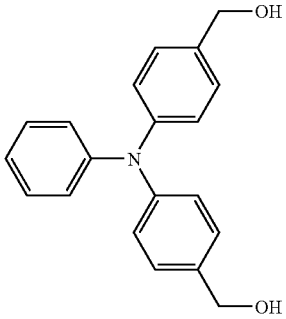
(3-2)
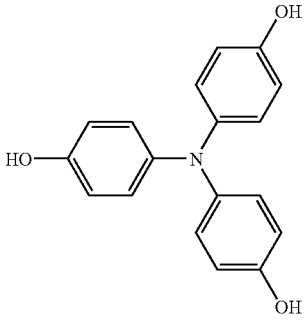
(3-3)
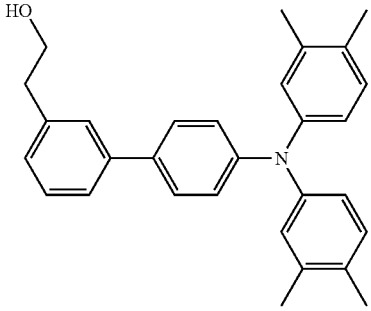
(3-4)
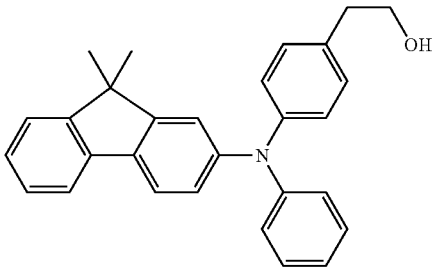
-continued
(3-5)
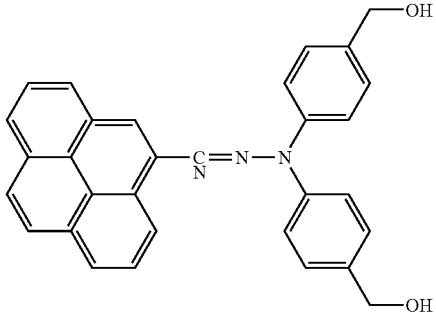
(3-6)
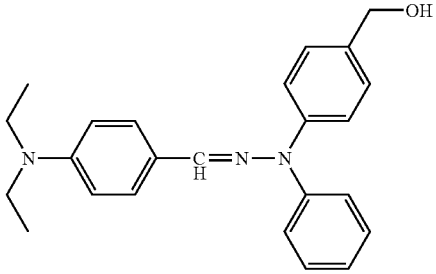
(3-7)
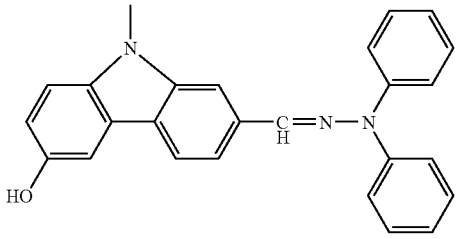
(3-8)
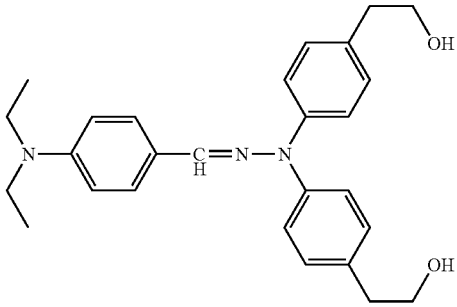
(3-9)
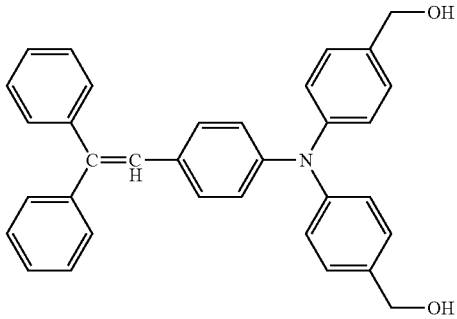

-continued (3-10)

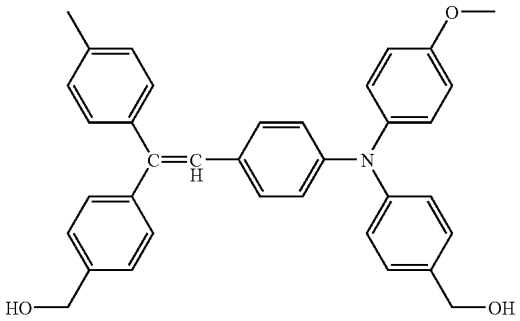

(3-11)

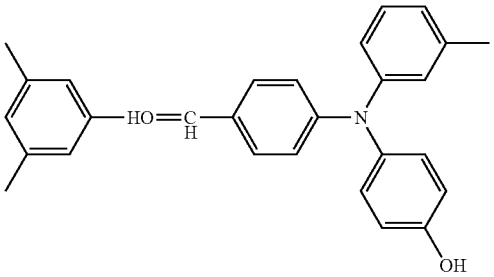

(3-12)

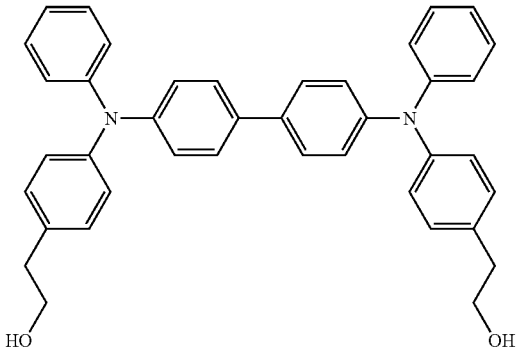

(3-13)

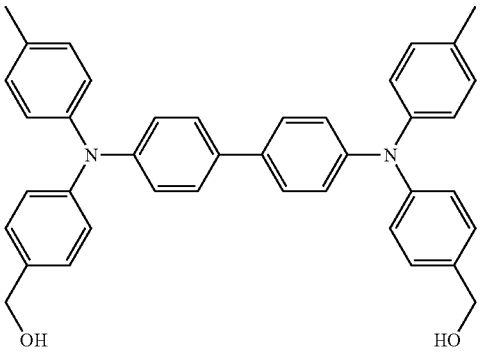

-continued (3-14)

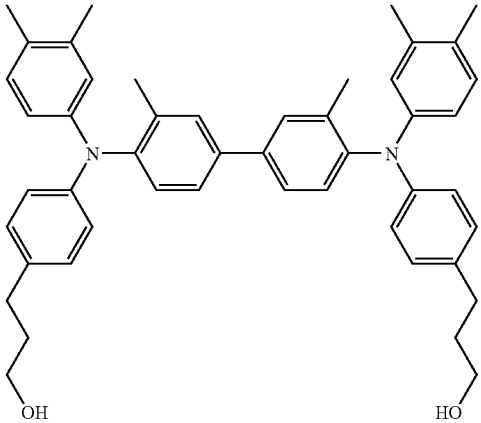

(3-15)

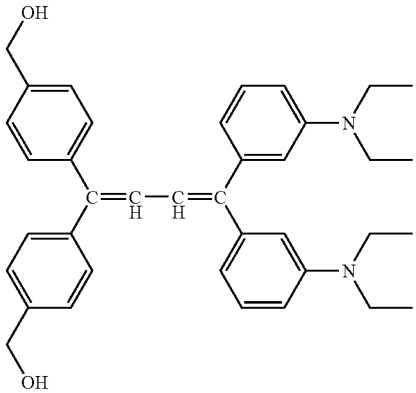

(3-16)

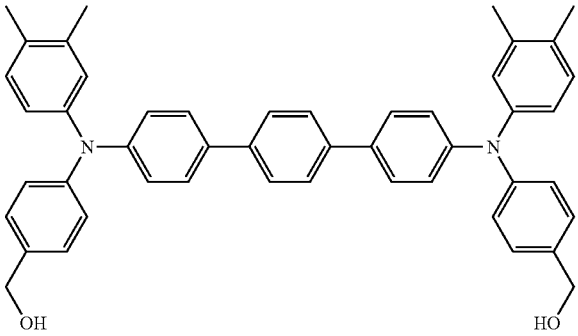

The photosensitive layer of the electrophotographic photoreceptor of the invention may be either a monolayer type photosensitive layer containing a charge generation material and a charge transfer material in the same layer, or a function separation type photoreceptor in which a layer containing the charge generation material (charge generation layer) and a layer containing the charge transfer material (charge transport layer) are separately provided. The siloxane resin-containing layer according to the invention means a layer containing the above-mentioned siloxane resin, of the monolayer type photosensitive layer, the charge generation layer, the charge transport layer, further a protective layer described later, etc.

Figure 2:
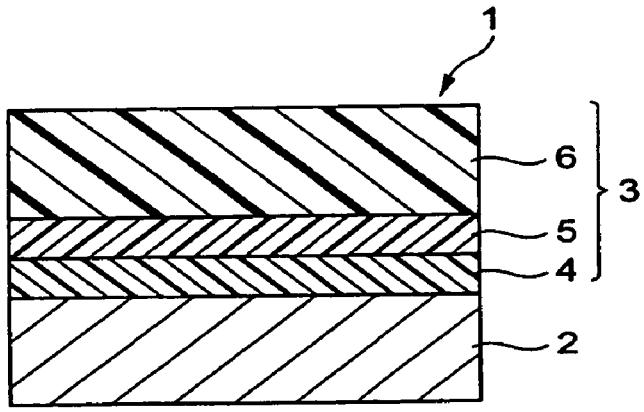
FIG. 2 is a schematic cross sectional view showing another embodiment of an image forming apparatus of the invention.
Figure 3:
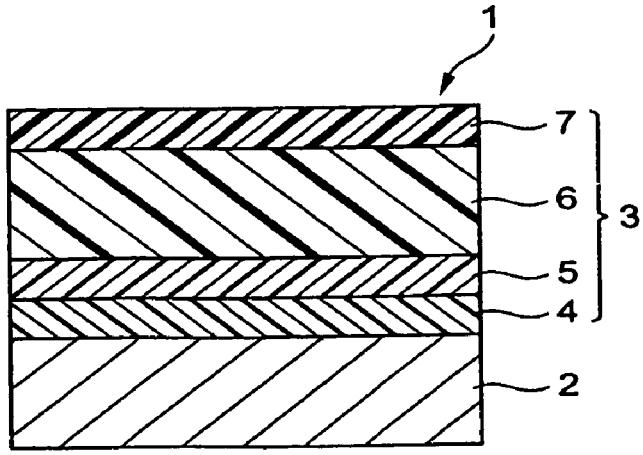
FIG. 3 is a schematic cross sectional view showing a still other embodiment of an image forming apparatus of the invention.

FIGS. 1 to 3 are each a schematic cross sectional view showing a preferred embodiment of the electrophotographic photoreceptor of the invention, and an electrophotographic photoreceptor 1 is cut along the lamination direction of a substrate 2 and a photosensitive layer 3. The electrophotographic photoreceptor 1 shown in each of FIGS. 1 to 3 is the function separation type photoreceptor, and the photosensitive layer 3 of each photoreceptor is separately provided with a charge generation layer 5 and a charge transport layer 6.

More specifically, in the electrophotographic photoreceptor 1 shown in FIG. 1, the charge generation layer 5 and the charge transport layer 6 are laminated in this order on the conductive substrate 2 to constitute the photosensitive layer 3, and in the electrophotographic photoreceptor 1 shown in FIG. 2, an undercoating layer 4, the charge generation layer 5 and the charge transport layer 6 are laminated in this order on the conductive substrate 2 to constitute the photosensitive layer 3. In the electrophotographic photoreceptor 1 shown in FIG. 3, an undercoating layer 4, the charge generation layer 5, the charge transport layer 6 and a protective layer 7 are laminated in this order on the conductive substrate 2 to constitute the photosensitive layer 3.

Respective constituent elements of the electrophotographic photoreceptor 1 will be described in detail below. In these embodiments, the charge transport layer 6 corresponds to the siloxane resin-containing layer containing the siloxane resin according to the invention.

The conductive support 2 includes, for example, a metal plate, a metal drum or a metal belt using a metal such as aluminum, copper, zinc, stainless steel, chromium, nickel, molybdenum, vanadium, indium, gold or platinum, or an alloy thereof; and paper or a plastic film or belt coated, deposited or laminated with a conductive polymer, a conductive compound such as indium oxide, a metal such as aluminum, palladium or gold, or an alloy thereof.

When the metal drum is used as the conductive substrate 2 in a laser printer, the oscillation wavelength of a laser beam is preferably from 350 to 850 nm. The laser beam having a shorter wavelength is preferred because of its excellent resolution. Further, in order to prevent interference fringes generated in laser beam irradiation, it is preferred that a surface of the substrate is roughened to a center line average roughness (Ra) of 0.04 to 0.5 μm. As a method for roughening the surface, preferred is wet honing conducted by spraying a suspension of an abrasive in water to the substrate, centerless grinding in which the substrate is pressed on a rotating grind stone to conduct grinding treatment continuously, or anodization. When Ra is less than 0.04 μm, it tends to become difficult to obtain the interference prevention effect, because the surface approaches a mirror surface. On the other hand, when Ra exceeds 0.5 μm, the image quality tends to become rough even in the case that a coating is formed on the substrate. When noninterference light is used as a light source, the surface roughening for the prevention of interference fringes is not particularly required, which prevents the occurrence of defects caused by unevenness of the substrate surface. Accordingly, this is suitable for the prolongation of the life.

In the anodization treatment, anodization is conducted in an electrolytic solution using aluminum as an anode, thereby forming an oxide film on a surface of aluminum. The electrolytic solutions include a solution of sulfuric acid and a solution of oxalic acid. However, the intact porous anodized film is chemically active, easily soiled, and large in fluctuations of resistance. Consequently, fine pores of the anodized film are sealed by volume expansion due to hydration reaction in pressurized water vapor or boiling water (a metal salt such as a nickel salt may be added) to conduct sealing treatment for converting the film to a more stable hydrated oxide.

The film thickness of the anodized film is preferably from 0.3 to 15 μm. When the film thickness is less than 0.3 μm, barrier properties to injection are poor, and the effect tends to become insufficient. On the other hand, exceeding 15 μm tends to cause an increase in residual potential by repeated use.

Further, it is also possible to treat the substrate with an acidic treating solution comprising phosphoric acid, chromic acid and hydrofluoric acid, and the treatment is conducted in the following manner. For the mixing ratio of phosphoric acid, chromic acid and hydrofluoric acid in the acidic treating solution, phosphoric acid is within the range of 10% to 11% by weight, chromic acid is within the range of 3% to 5% by weight, and hydrofluoric acid is within the range of 0.5% to 2% by weight. The overall concentration of these acids is preferably from 13.5% to 18% by weight. Although the treating temperature is from 42° C. to 48° C., the thicker coating can be formed more rapidly by keeping the treating temperature high. The film thickness of the coating is preferably from 0.3 to 15 μm. When the film thickness is less than 0.3 μm, barrier properties to injection are poor, and the effect tends to become insufficient. On the other hand, exceeding 15 μm tends to cause an increase in residual potential by repeated use.

Boehmite treatment can be conducted by immersing the substrate in pure water of 90 to 100° C. for 5 to 60 minutes or by bringing the substrate into contact with heated water vapor of 90 to 120° C. for 5 to 60 minutes. The film thickness of the coating is preferably from 0.1 to 5 μm. This may be further anodized using an electrolytic solution low in film solubility, such as a solution of adipic acid, boric acid, a borate, a phosphate, a phthalate, a maleate, a benzoate, a tartrate or a citrate.

The charge generation layer 5 is provided on the conductive substrate 2 as shown in FIG. 1. The charge generation materials used in the charge generation layer 5 include, for example, various organic pigments such as an azo pigment, a quinone pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment and a triphenylmethane pigment; various dyes such as an azulenium dye, a squalium dye, a pyrylium dye, a triallylmethane dye, a xanthene dye, a thiazine dye and cyanine dye; and further inorganic materials such as amorphous silicon, amorphous selenium, tellurium, a selenium-tellurium alloy, cadmium sulfide, antimony sulfide, zinc oxide and zinc sulfide. The cyclocondensed aromatic pigments, the perylene pigment and the azo pigment are preferred in terms of sensitivity, electric stability and photochemical stability against irradiated light.

In using the charge generation materials in the photosensitive layer (photoconductive layer), they can be used either alone or as a mixture of two or more of them. The charge generation layer 5 is formable by vacuum deposition of the charge generation material or application of a coating solution in which the charge generation material is dispersed in an organic solvent containing a binding resin.

The binding resins used in coating include a polyvinyl acetal resin such as a polyvinyl butyral resin, a polyvinyl formal resin or a partially acetalized polyvinyl acetal resin in which butyral is partially modified with formal or acetoacetal, a polyamide resin, a polyester resin, a modified ether type polyester resin, a polycarbonate resin, an acrylic resin, a polyvinyl chloride resin, a polyvinylidene chloride, a polystyrene resin, a polyvinyl acetate resin, a vinyl chloride-vinyl acetate copolymer, a silicone resin, a phenol resin, a phenoxy resin, a melamine resin, a benzoguanamine resin, a urea resin, a polyurethane resin, a poly-N-vinylcarbazole resin, a polyvinylanthracene resin and a polyvinylpyrene resin. Of these, the polyvinyl acetal resin, the vinyl chloride-vinyl acetate copolymer, the phenoxy resin or the modified ether type polyester resin well disperses the pigment to cause no occurrence of coagulation of the pigment, thereby obtaining the coating solution stable for a long period of time. The use of the coating solution makes it possible to form a uniform coating. As a result, the electric characteristics are improved, thereby being able to decrease image defects. However, the binding resins are not limited to these resins, as long as they can form coatings in a normal state. These binding resins can be used either alone or as a mixture of two or more of them. Further, the mixing ratio of the charge generation material to the binding resin is preferably within the range of 5:1 to 1:2 by volume ratio.

In forming the charge generation layer 5, the coating solution in which the above-mentioned materials are appropriately compounded is used. The solvents used in preparing the coating solution include organic solvents normally used such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform. They can be used either alone or as a mixture of two or more of them.

As a coating method, a method normally used such as blade coating, Mayer bar coating, spray coating, dip coating, bead coating, air knife coating or curtain coating can be employed.

The film thickness of the charge generation layer 5 is generally from 0.01 to 5 μm, and preferably from 0.1 to 2 μm. When the film thickness is less than 0.01 μm, it tends to become difficult to uniformly form the charge generation layer. On the other hand, when it exceeds 5 μm, the electrophotographic characteristics tend to significantly deteriorate.

Further, a stabilizer such as an antioxidant or an inactivating agent can also be added to the charge generation layer. The antioxidants include, for example, antioxidants such as phenolic, sulfur, phosphorus and amine compounds. The inactivating agents include bis(dithiobenzyl)nickel and nickel di-n-butylthiocarbamate.

The undercoating layer 4 can also be provided between the charge generation layer 5 and the conductive substrate 2 as shown in FIGS. 2 and 3. Materials used for the undercoating layer 4 include organic metal compounds, for example, an organic zirconium compound such as a zirconium chelate compound, a zirconium alkoxide compound or a zirconium coupling agent, an organic titanium compound such as a titanium chelate compound, a titanium alkoxide compound or a titanate coupling agent, an organic aluminum compound such as an aluminum chelate compound or an aluminum coupling agent, an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound. In particular, the organic zirconium compounds, the organic titanyl compounds and the organic aluminum compounds are preferably used, because they shows low residual potential and excellent electrophotographic characteristics.

The undercoating layer can further contain a coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane or β-3,4-epoxycyclohexyltrimethoxysilane.

Further, there can also be used known binding resins such as polyvinyl alcohol, polyvinyl methyl ether, poly-N-vinylimidazole, polyethylene oxide, ethyl cellulose, methyl cellulose, an ethylene-acrylic acid copolymer, a polyamide, a polyimide, casein, gelatin, polyethylene, a polyester, a phenol resin, a vinyl chloride-vinyl acetate resin, an epoxy resin, polyvinylpyrrolidone, polyvinylpyridine, a polyurethane, polyglutamic acid and polyacrylic acid, which have been used in the conventional undercoating layers.

The mixing ratio of these materials can be appropriately set according to need. Further, an electron transfer pigment can also be used in the undercoating layer by mixing/dispersing. The electron transfer pigments include organic pigments such as the perylene pigment, the bisbenzimidazole perylene pigment, the polycyclic quinone pigment, the indigo pigment and the quinacridone pigment, which are described in JP-A-47-30330, organic pigments such as a bisazo pigment having an electron attractive substituent group such as a cyano group, a nitro group, a nitroso group or a halogen atom and a phthalocyanine pigment, and inorganic pigments such as zinc oxide and titanium oxide. Of these pigments, the perylene pigment, the bisbenzimidazole perylene pigment, the polycyclic quinone pigment, zinc oxide and titanium oxide are preferably used because of their high electron mobility.

These pigments may be surface treated with a silane coupling agent, a titanate coupling agent or the like. When the electron transfer pigment is too much, the strength of the undercoating layer tends to decrease to cause coating defects. It is therefore used preferably in an amount of 95% by weight or less, and more preferably in an amount of 90% by weight or less. A conventional method using a ball mill, a roll mill, a sand mill, an attriter, an ultrasonic wave or the like is applied to the mixing/dispersing.

The mixing/dispersing is conducted in an organic solvent, and as the organic solvent, any solvent can be used as long as it dissolves the organic metal compound or the resin, and does not cause gelation or coagulation when the electron transfer pigment is mixed/dispersed. The solvents include, for example, conventional organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. They can be used either alone or as a mixture of two or more of them. The film thickness of the undercoating layer 4 is preferably from 0.1 to 30 μm, and more preferably from 0.2 to 25 μm.

As shown in FIGS. 1 to 3, the charge transport layer 6 is provided on the charge generation layer 5. In these embodiments, the charge transport layer 6 is the siloxane resin-containing layer containing the siloxane resin according to the invention, as described above.

When the charge transport layer 6 containing the siloxane resin is formed, the organic silicon compound is first reacted with the compound represented by general formula (3). Then, the charge transfer material and the binding resin are added to the reaction solution, and further, an additive, fine particles, a crosslinking agent, etc. are added as needed to prepare a coating solution for formation of the charge transport layer (a coating solution preparing step). The use of the organic silicon compound as a material for the siloxane resin as described above increases reaction sites in forming the resin to improve reactivity and to sufficiently increase the crosslinking density of the resulting resin, and further, introduces the organic group derived from the compound having higher hole transport capability into the resin. This is considered to have improved the stain resistance and durability of the electrophotographic photoreceptor.

The low charge transfer materials include pyrene, carbazole, hydrazone, oxazole, oxadiazole, pyrazoline, arylamine, arylmethane, benzidine, thiazole, stilbene and butadiene compounds, for low molecular weight compounds, and poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, for high molecular weight compounds. Of these, the triphenylamine compound, the triphenylmethane compound and the benzidine compound are preferred in terms of mobility, stability and transparency to light.

As the binding resin, a high molecular weight polymer which can form an electrical insulating film is preferred. Such high molecular weight polymers include but are not limited to a polycarbonate, a polyester, a methacrylic resin, an acrylic resin, polyvinyl chloride, polyvinylidene chloride, polystyrene, polyvinyl acetate, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, polyvinyl butyral, polyvinyl formal, a polysulfone, casein, gelatin, polyvinyl alcohol, ethyl cellulose, a phenol resin, a polyamide, carboxymethyl cellulose, a vinylidene chloride-based polymer latex and a polyurethane. Of these, the polycarbonate, the polyester, the methacrylic resin and the acrylic resin are preferred, because they are excellent in compatibility with the charge transfer material, solubility in the solvent and strength. These binding resins can be used either alone or as a mixture of two or more of them.

Further, a compound represented by the following general formula (35) is preferably added, because properties such as strength and film resistance can be controlled:

$$Si(R^{11})_{(3-b)}Q_b \quad (35)$$

wherein $R^{11}$ represents a hydrogen atom, an alkyl group or a substituted or unsubstituted aryl group, Q represents a hydrolytic group, and b represents an integer of 1 to 4.

Specific examples of the compounds represented by the above-mentioned formula (35) include silane coupling agents such as a tetrafunctional alkoxysilane (b=4) such as tetramethoxysilane or tetraethoxysilane; a trifunctional alkoxysilane (b=3) such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane or 1H,1H,2H,2H-perfluorooctyltriethoxysilane; a bifunctional alkoxysilane (b=2) such as dimethyldimethoxysilane, diphenyldimethoxysilane or methylphenyldimethoxysilane; and a monofunctional alkoxysilane (b=1) such as trimethylmethoxysilane. In order to improve the strength of the charge transport layer, the trifunctional and tetrafunctional alkoxysilanes are preferred, and in order to improve the flexibility and film forming properties, the monofunctional and bifunctional alkoxysilanes are preferred. When such a compound is added to the coating solution for formation of the charge transport layer, the siloxane resin can have the structural unit represented by general formula (6).

Silicone hard coating agents prepared mainly from these coupling agents can also be added. As commercially available hard coating agents, there can be used KP-85, X-40-9740 and X-40-2239 (the above are manufactured by Shinetsu Silicone Co., Ltd.), and AY42-440, AY42-441 and AY49-208 (the above are manufactured by Toray Dow Corning Co., Ltd.).

As the fine particles, preferred are fine particles containing silicon, fine fluorine-based particles, fine particles comprising resins and fine particles comprising semiconductive metal oxides. Such fine particles have the effect of improving the stain adhesion resistance and lubricity of the surface of the electrophotographic photoreceptor. These fine particles can be used either alone or as a mixture of two or more of them.

The fine particles containing silicon are fine particles containing silicon as a constituent element, and specifically include colloidal silica and fine silicone particles. Colloidal silica used as the fine particles containing silicon is selected from an acidic or alkaline aqueous dispersion of the fine particles having an average particle size of 1 to 100 nm, preferably 10 to 30 nm, and a dispersion of the fine particles in an organic solvent such as an alcohol, a ketone or an ester, and generally, commercially available particles can be used.

There is no particular limitation on the solid content of colloidal silica in the electrophotographic photoreceptor of this embodiment. However, colloidal silica is used within the range of 1 to 50% by weight, preferably within the range of 5 to 30% by weight, based on the total solid content of the charge transport layer 6, in terms of film forming properties, electric characteristics and strength.

The fine silicone particles used as the fine particles containing silicon are silicone resin particles, silicone rubber particles or silica particles surface-treated with silicone, which are spherical and have an average particle size of preferably 1 to 500 nm and more preferably 10 to 100 nm, and generally, commercially available particles can be used.

The fine silicone particles are small-sized particles which are chemically inactive and excellent in dispersibility in a resin, and further low in the content necessary for obtaining sufficient characteristics. Accordingly, the surface properties of the electrophotographic photoreceptor can be improved without inhibition of the crosslinking reaction. That is to say, the fine silicone particles improve the lubricity and water repellency of a surface of the electrophotographic photoreceptor in a state where they are incorporated into a strong crosslinked structure, thereby being able to maintain good wear resistance and stain adhesion resistance for a long period of time. The content of the fine silicone particles in the charge transport layer in the electrophotographic photoreceptor of this embodiment is preferably within the range of 0.1 to 20% by weight, and more preferably within the range of 0.5 to 10% by weight, based on the total solid content of the charge transport layer.

The fine fluorine-based particles include ethylene tetrafluoride, ethylene trifluoride, propylene hexafluoride, vinyl fluoride and vinylidene fluoride, and the fine particles comprising resins include fine particles obtained by copolymerizing a fluororesin with a hydroxyl group-containing monomer, which is described in *Proceedings of Lectures in the Eighth Polymer Material Forum*, page 89. The fine particles comprising semiconductive metal oxides include fine particles comprising semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

Further, for a similar purpose, an oil such as a silicone oil can also be added. The oils include a silicone oil such as dimethylpolysiloxane, diphenylpolysiloxane or phenylmethylsiloxane; and a reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane or phenol-modified polysiloxane.

Furthermore, a cyclic compound having a repeating structural unit represented by the following general formula (36) or a derivative thereof can also be added:

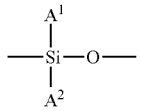

(36)

wherein $A^1$ and $A^2$ each independently represents a monovalent organic group.

The cyclic compounds having repeating structural units represented by general formula (36) include commercially available cyclic siloxanes. Specifically, the siloxanes include cyclic siloxanes such as a cyclic dimethylcyclosiloxane such as hexamethylcyclotrisiloxane, octamethylcyclotetrasiloxane, decamethylcyclopentasiloxane or dodecamethylcyclohexasiloxane; a cyclic methylphenylcyclosiloxane such as 1,3,5-trimethyl-1,3,5-triphenylcyclotrisiloxane, 1,3,5,7-tetramethyl-1,3,5,7-tetraphenylcyclotetrasiloxane or 1,3,5,7,9-pentamethyl-1,3,5,7,9-pentaphenylcyclopentasiloxane; a cyclic phenylcyclosiloxane such as hexaphenylcyclotrisiloxane; a fluorine-containing cyclosiloxane such as 3-(3,3,3-trifluoropropyl)methylcyclotricyloxane; a hydrosilyl group-containing cyclosiloxane such as a methylhydroxysiloxane mixture, pentamethylcyclopentasiloxane or phenylhydrocyclosiloxane; and a vinyl group-containing cyclosiloxane such as pentavinylpentamethylcyclopentasiloxane. These cyclic siloxane compounds may be used either alone or as a mixture of two or more of them.

Further, a plasticizer, a surface modifier, an antioxidant, an agent for preventing deterioration by light, etc. can also be added to the coating solution for formation of the charge transport layer. The plasticizers include, for example, biphenyl, biphenyl chloride, terphenyl, dibutyl phthalate, diethylene glycol phthalate, dioctyl phthalate, triphenylphosphoric acid, methylnaphthalene, benzophenone, chlorinated paraffin, polypropylene, polystyrene and various fluorohydrocarbons.

Further, an antioxidant having a hindered phenol, hindered amine, thioether or phosphite partial structure can also be added. This is effective for improvement of potential stability and image quality in environmental variation.

The antioxidants include, for example, SUMILIZER BHT-R, SUMILIZER MDP-S, SUMILIZER BBM-S, SUMILIZER WX-R, SUMILIZER NW, SUMILIZER BP-76, SUMILIZER BP-101, SUMILIZER GA-80, SUMILIZER GM and SUMILIZER GS (the above are manufactured by Sumitomo Chemical Co., Ltd.), IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WL, IRGANOX 1520L, IRGANOX 245, IRGANOX 259, IRGANOX 3114, IRGANOX 3790, IRGANOX 5057 and IRGANOX 565 (the above are manufactured by Ciba Specialty Chemicals), and ADECASTAB AO-20, ADECASTAB AO-30, ADECASTAB AO-40, ADECASTAB AO-50, ADECASTAB AO-60, ADECASTAB AO-70, ADECASTAB AO-80 and ADECASTAB AO-330 (the above are manufactured by Asahi Denka Co., Ltd.), as the hindered phenol antioxidants.

Further, the hindered amine antioxidants include SANOL LS2626, SANOL LS765, SANOL LS770, SANOL LS744, TINUVIN 144, TINUVIN 622LD, MARK LA57, MARK LA67, MARK LA62, MARK LA68, MARK LA63 and SUMILIZER TPS. The thioether antioxidants include SUMILIZER TP-D, and the phosphite antioxidants include MARK 2112, MARK PEP·8, MARK PEP·24G, MARK PEP·36, MARK 329K and MARK HP·10. In particular, the hindered phenol and hindered amine antioxidants are preferred.

Further, the addition of a resin soluble in an alcoholic or ketone solvent, or a resin soluble in a component other than the resin achieves the effects of improving discharge gas resistance, mechanical strength, scratch resistance and particle dispersibility, controlling viscosity, reducing torque, controlling abrasion loss, and prolonging pot life. The alcoholic or ketone solvent-soluble resins include a polyvinyl acetal resin (for example, S-LEC B or K, manufactured by Sekisui Chemical Co., Ltd.) such as a polyvinyl butyral resin, a polyvinyl formal resin or a partially acetalized polyvinyl acetal resin in which butyral is partially modified with formal or acetoacetal, a polyamide resin, a cellulose resin and a phenol resin. In particular, the polyvinyl acetal resin is preferred in terms of electric characteristics.

The molecular weight of the above-mentioned resin is preferably from 2,000 to 100,000, and more preferably from 5,000 to 50,000. When the average molecular weight is less than 2,000, the desired effect tends to be not obtained. On the other hand, when it exceeds 100,000, the solubility decreases, thereby being liable to limit the amount thereof added and to contribute poor film formation in coating.

Further, the amount of the above-mentioned resin added is preferably from 1 to 40% by weight, and more preferably from 5 to 30% by weight, based on the total solid content of the charge transport layer. In the case of less than 1% by weight, it tends to become difficult to obtain the desired effect. On the other hand, exceeding 15% by weight results in a tendency to cause an indistinct image at high temperature and high humidity. These resins may be used either alone or as a mixture of them.

It is preferred that a catalyst is added to the coating solution for formation of the charge transport layer in or after the coating solution preparing step. The catalysts include an inorganic acid such as hydrochloric acid, phosphoric acid or sulfuric acid; an organic acid such as formic acid, acetic acid, propionic acid, oxalic acid, p-toluenesulfonic acid, benzoic acid, phthalic acid or maleic acid; and an alkali catalyst such as potassium hydroxide, sodium hydroxide, calcium hydroxide, ammonia or triethylamine. Further, a solid catalyst insoluble in the system, as shown below, can also be used. There is no particular limitation on the solid catalyst insoluble in the system, as long as the catalyst component is insoluble in the compound represented by general formula (3), the organic silicon compound, the charge transfer material, the binding resin, the above-mentioned additive, water, the solvent, etc.

The solid catalysts include cation exchange resins such as AMBERLITE 14, AMBERLITE 200C and Amberlist 15E (the above are manufactured by Rhom & Haas Co.), DOWEX MWC-1-H, DOWEX 88 and DOWEX HCR-W2 (the above are manufactured by Dow Chemical Co.), LEVATIT SPC-108 and LEVATIT SPC-118 (the above are manufactured by Bayer AG), DIAION RCP-150H (manufactured by Mitsubishi Chemical Corporation), SUMIKAION KC-470, DUOLITE C26-C, DUOLITE C-433 and DUOLITE 464 (the above are manufactured by Sumitomo Chemical Co., Ltd.), and Nafion H (manufactured by E.I. du Pont de Nemours and Company); anionic exchange resins such as AMBERLITE IRA-400 and AMBERLITE IRA-45 (the above are manufactured by Rhom & Haas Co.); inorganic solids to whose surfaces protonic acid group-containing groups are bonded, such as $Zr(O_3PCH_2CH_2SO_3H)_2$ and $Th(O_3PCH_2CH_2COOH)_2$; protonic acid group-containing polyorganosiloxanes such as a sulfonic acid-containing polyorganosiloxane; heteropolyacids such as cobalt tungstic acid and phosphorous molybdic acid; isopolyacids such as niobic acid, tantalic acid and molybdic acid; unitary metal oxides such as silica gel, alumina, chromia, zirconia, CaO and MgO; complex metal oxides such as silica-alumina, silica-magnesia, silica-zirconia and zeolite; clay minerals such as acid clay, activated clay, montmorillonite and kaolinite; metal sulfates such as $LiSO_4$ and $MgSO_4$; metal phosphates such as zirconia phosphate and lanthanum phosphate; metal nitrates such as $LiNO_3$ and $Mn(NO_3)_2$; inorganic solids to whose surfaces amino group-containing groups are bonded, such as a solid obtained by reacting aminopropyltriethoxysilane on silica gel; and amino group-containing polyorganosiloxanes such as an amino-modified silicon resin.

The use of the above-mentioned solid catalyst in the coating solution preparing step is preferred, because the stability of the coating solution for formation of the charge transport layer. Although there is no particular limitation on the amount of the solid catalyst used, it is preferably from 0.1 to 100 parts by weight based on 100 parts by weight of the organic silicon compound. These solid catalysts are insoluble in the above-mentioned respective components as described above, so that they can be easily removed by conventional methods after the reaction.

Although the reaction temperature and reaction time in the coating solution preparing step are appropriately selected depending on the kind and amount used of the compound represented by general formula (3), the raw materials such as the organic silicon compound, and the catalyst, the reaction temperature is preferably from 0 to 100° C., and more preferably from 15 to 50° C., and the reaction time is preferably from 10 minutes to 100 hours. When the reaction time exceeds the above-mentioned upper limit value, gelation tends to easily occur.

Further, when the solid catalyst insoluble in the system is used in the coating solution preparing step, a catalyst soluble in the system, for example, a metal chelate compound, is preferably used in combination therewith in order to improve strength, solution storage stability, etc. As such a metal chelate compound, there can be used an aluminum cheltate compound or an organic aluminum compound such as aluminum triethylate, aluminum triisopropylate, aluminum tri(sec-butyrate), mono(sec-butoxy)aluminum diisopropylate, diisopropoxyaluminum (ethylacetoacetate), aluminum tris(ethylacetoacetate), aluminum bis (ethylacetoacetate) monoacetylacetonate, aluminum tris (acetylacetonate), aluminum diisopropoxy(acetylacetonate), aluminum isopropoxy-bis(acetylacetonate), aluminum tris (trifluoroacetylacetonate) or aluminum tris(hexafluoroacetylacetonate), in addition to the compounds described above.

Other than the organic aluminum compound, there can be used an organic tin compound such as dibutyltin dilaurate, dibutyltin dioctylate or dibutyltin diacetate; an organic titanium compound such as titanium tetrakis(acetylacetonate), titanium bis(butoxy)bis(acetylacetonate) or titanium bis(isopropoxy)bis(acetylacetonate); and a zirconium compound such as zirconium tetrakis(acetylacetonate), zirconium bis (butoxy)bis(acetylacetonate) or zirconium bis(isopropoxy) bis(acetylacetonate).

However, from the viewpoints of safety, low cost and long pot life, the organic aluminum compounds are preferably used, and the aluminum chelate compound is particularly preferably used.

Although there is no particular limitation on the amount of the metal chelate compound used, it is preferably from 0.1 to 20 parts by weight, and particularly preferably from 0.3 to 10 parts by weight, based on 100 parts by weight of the organic silicon compound.

When the metal chelate compound is used in this embodiment, it is preferred in terms of pot life and curing efficiency that a multidentate ligand is added to the coating solution for formation of the charge transport layer. Such multidentate ligands include the following compounds and derivatives thereof.

Specific examples thereof include didentate ligands such as a β-diketone such as acetylacetone, trifluoroacetylacetone, hexafluoroacetylacetone or dipivaloylmethylacetone, an acetoacetate such as methyl acetoacetate and ethyl acetoacetate, bipyridine and a derivative thereof, glycine and a derivative thereof, ethylenediamine and a derivative thereof, 8-oxyquinoline and a derivative thereof, salicylaldehyde and a derivative thereof, catechol and a derivative thereof, and a 2-oxyazo compound; tridentate ligands such as diethyltriamine and a derivative thereof, and nitriloacetic acid and a derivative thereof; and hexadentate ligands such as ethylenediaminetetraacetic acid (EDTA) and a derivative thereof.

Further, in addition to the organic ligands as described above, the multidentate ligands include inorganic ligands such as pyrophosphoric acid and triphosphoric acid. As the multidentate ligand, the didentate ligand is particularly preferred. More preferably, a didentate ligand represented by the following general formula (37) is preferred, and it is particularly preferred that $R^{12}$ and $R^{13}$ in the following general formula (37) are the same. When $R^{12}$ and $R^{13}$ are the same, the coordinate force of the ligand in the neighborhood at room temperature is enhanced to allow a coating agent to be more stabilized.

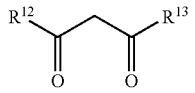

(37)

wherein $R^{12}$ and $R^{13}$ each independently represents an alkyl or fluorinated alkyl group having 1 to 10 carbon atoms or an alkoxyl group having 1 to 10 carbon atoms.

Although the amount of the multidentate ligand compounded can be arbitrarily set, it is preferably 0.01 mole or more, more preferably 0.1 mole or more, and still more preferably 1 mole or more, based on mole of organic metal compound used.

The preparation of the coating solution for formation of the charge transport layer in the coating solution preparing step can also be conducted in a solventless state. However, it can be conducted by mixing or stirring the above-mentioned respective components using a solvent described below as needed. The solvents usable herein include various solvents, as well as an alcohol such as methanol, ethanol, propanol or butanol; a ketone such as acetone or methyl ethyl ketone; tetrahydrofuran; and an ether such as diethyl ether or dioxane. As such a solvent, a solvent having a boiling point of 100° C. or lower is preferred. The above-mentioned solvents can also be used as an arbitrary mixture of them. The amount of the solvent may be any, but too small an amount results in a tendency to precipitate the organic silicon compound. Accordingly, the solvent is added preferably in an amount of 0.5 to 30 parts by weight, and more preferably in an amount of 1 to 20 parts by weight, based on 1 part by weight of the organic silicon compound.

Then, the charge transport layer 6 is formed using the resulting coating solution for formation of the charge transport layer (a siloxane resin-containing layer forming step). Coating methods include conventional methods as described in the formation of the charge generation layer 5. In this embodiment, the coating solution is applied onto the charge generation layer 5.

There is no particular limitation on the curing temperature and the curing time in curing the coating solution for formation of the charge transport layer. However, in terms of the mechanical strength and chemical stability of the cured siloxane resin, the curing temperature is preferably 60° C. or higher, and more preferably from 80 to 200° C., and the curing time is preferably from 10 minutes to 5 hours. Further, for the purpose of stabilizing the characteristics of the charge transport layer, it is effective to keep in a high humidity state the charge transport layer obtained by curing the coating solution for formation of the charge transport layer. Further, the charge transport layer can be surface treated with hexamethyldisilazane or trimethylchlorosilane to make it hydrophobic, depending on its use.

The film thickness of the charge transport layer 6 is preferably from 5 to 50 μm, and more preferably from 10 to 40 μm. When the film thickness is less than 5 μm, it tends to become difficult to be charged. On the other hand, exceeding 50 μm results in a tendency to significantly deteriorate the electrophotographic characteristics.

The protective layer 7 can also be provided on the charge transport layer 6 as shown in FIG. 3. The protective layer 7 comprises a resin soluble in an alcohol or a resin soluble in a component other than the resin. Further, it is preferred that the protective layer is allowed to contain a compound having two or more silicon atoms in its molecule, a hydrolysate thereof or a hydrolysate condensation product thereof, because the protective layer high in strength can be formed. Furthermore, as components used, it is possible to use components approximately similar to those described for the charge transport layer.

In addition, as a solvent used for formation of the protective layer, preferred is a solvent which dissolves the constituent materials of the protective layer and is difficult to attack the protective layer, the undercoating layer. The solvents include an alcohol such as methanol, ethanol, propanol, isopropanol, butanol, t-butanol or cyclohexanol; an ether such as diethyl ether, dibutyl ether, dimethoxyethane or diethoxyethane; an aromatic solvent such as xylene or p-cymene; and a cellosolve such as methyl cellosolve or ethyl cellosolve. Above all, the alcohol having a boiling point of 60 to 150° C. is particularly preferred in terms of film forming properties and storage stability of the coating solution.

The film thickness of the protective layer is preferably from 0.1 to 10 μm, and more preferably from 0.5 to 7 μm. As a coating method for forming this protective layer, a conventional method such as blade coating, Mayer bar coating, spray coating, dip coating, bead coating, air knife coating or curtain coating can be used.

Image Forming Apparatus and Process Cartridge

Figure 4:
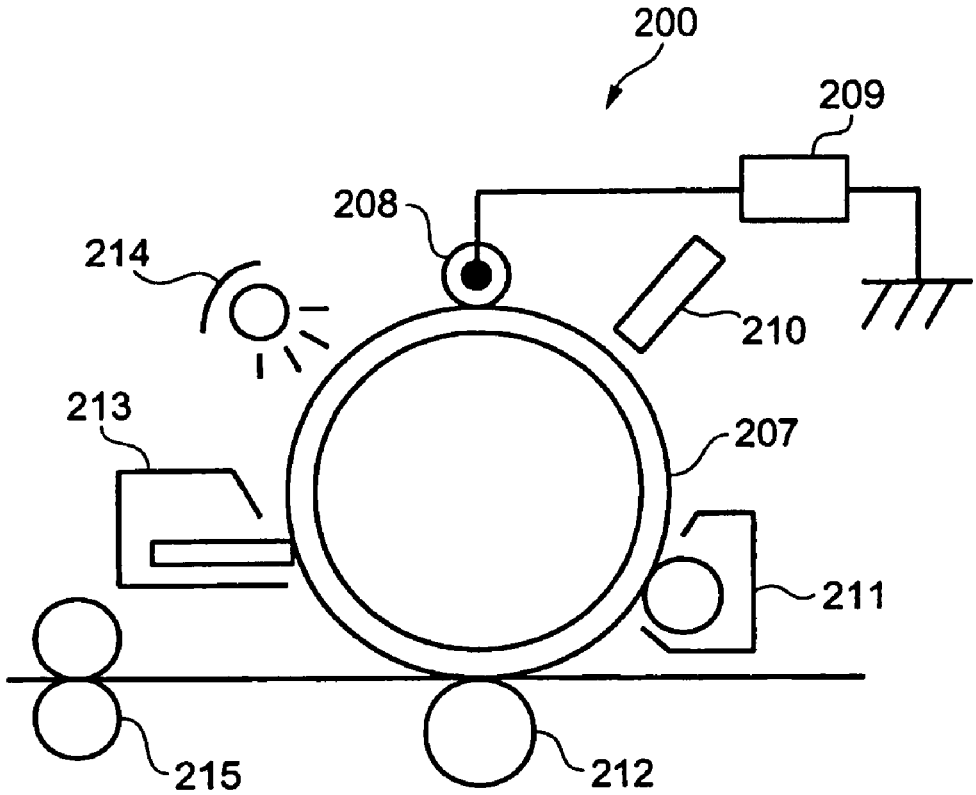
FIG. 4 is a schematic view showing a preferred embodiment of an image forming apparatus of the invention.

FIG. 4 is a cross sectional view schematically showing a basic structure of a preferred embodiment of the image forming apparatus of the invention. The image forming apparatus 200 shown in FIG. 4 comprises an electrophotographic photoreceptor 207 of the invention, a charging device 208 for charging the electrophotographic photoreceptor 207 by a contact charging system, a power supply 209 connected to the charging device 208, an exposure device 210 for exposing the electrophotographic photoreceptor 207 charged by the charging device 208 to form a electrostatic latent image, a developing device 211 for developing the electrostatic latent image formed by the exposure device 210 with a toner to form a toner image, a transfer device 212 for transferring the toner image formed by the developing device 211 to a medium 500 to which the toner image is to be transferred, a cleaning device 213, a static eliminator 214 and a fixing device 215. There may be the case where the apparatus is not provided with the static eliminator.

In the charging device 208 shown in FIG. 4, a contact type charging member (for example, a charging roll) is brought into contact with a surface of the photoreceptor 207 to uniformly apply voltage to the photoreceptor, thereby charging the surface of the photoreceptor to a desired potential.

As the contact type charging member, there is suitably used a roller-shaped charging member in which an elastic layer, a resistive layer and a protective layer are provided on a peripheral surface of a core member. The contact type charging member may be in any shape, for example, in the shape of a brush, a blade or a pin electrode, as well as in the roller shape described above, and the shape thereof can be arbitrarily selected depending on the specification or configuration of the image forming apparatus.

As the material for the core member in the roller-shaped contact type charging member, there can be used a conductive material such as iron, copper, brass, stainless steel, aluminum or nickel. Further, a resin molded article in which conductive particles are dispersed can be used. As a material for the elastic layer, a conductive or semiconductive material such as a dispersion of conductive or semiconductive particles in a binding resin is usable. Materials for the resistive layer and the protective layer include a material in which conductive or semiconductive particles are dispersed in a binding resin to control its resistivity.

When the photoreceptor is charged using these contact type charging members, a voltage is applied to the contact type charging members. Such an applied voltage may be any one of a DC voltage, an AC voltage, and a voltage in which an AC voltage is superimposed on a DC voltage.

In place of the contact type charging member shown in FIG. 4, it is also possible to use a non-contact type corona charger such as a corotron charger or a scorotron charger. These can be arbitrarily selected depending on the specification or configuration of the image forming apparatus.

As the exposure device 210, there can be used an optical device which can perform desired imagewise exposure to a surface of the electrophotographic photoreceptor with a light source such as a semiconductor laser, an LED (light emitting diode) or a liquid crystal shutter.

As the developing device 211, there can be used a known developing device using a normal or reversal developing agent of a one-component system, a two-component system or the like. Although there is no particular limitation on the shape of a toner used, a spherical toner is preferred from the viewpoints of high image quality and ecology.

As the transfer device 212, there can be used a contact type transfer charging device using a belt, a roller, a film, a rubber blade or the like, or a scorotron transfer charger or a corotron transfer charger utilizing corona discharge, as well as a roller-shaped contact type charging member.

The cleaning device 213 is a device for removing a remaining toner adhered to the surface of the electrophotographic photoreceptor after a transfer step, and the electrophotographic photoreceptor cleaned up thereby is repeatedly subjected to the above-mentioned image formation process. As the cleaning device, there can be used, a cleaning brush, a cleaning roll or the like, as well as a cleaning blade. Of these, the cleaning blade is preferably used. Materials for the cleaning blade include urethane rubber, neoprene rubber and silicone rubber.

In addition, the image forming apparatus of the invention may be further equipped with an erase light irradiation device 214, as shown in FIG. 4. This prevents the phenomenon of incorporating the residual potential of the electrophotographic photoreceptor into the subsequent cycle, when the electrophotographic photoreceptor is repeatedly used. Accordingly, image quality can be more improved.

Figure 5:
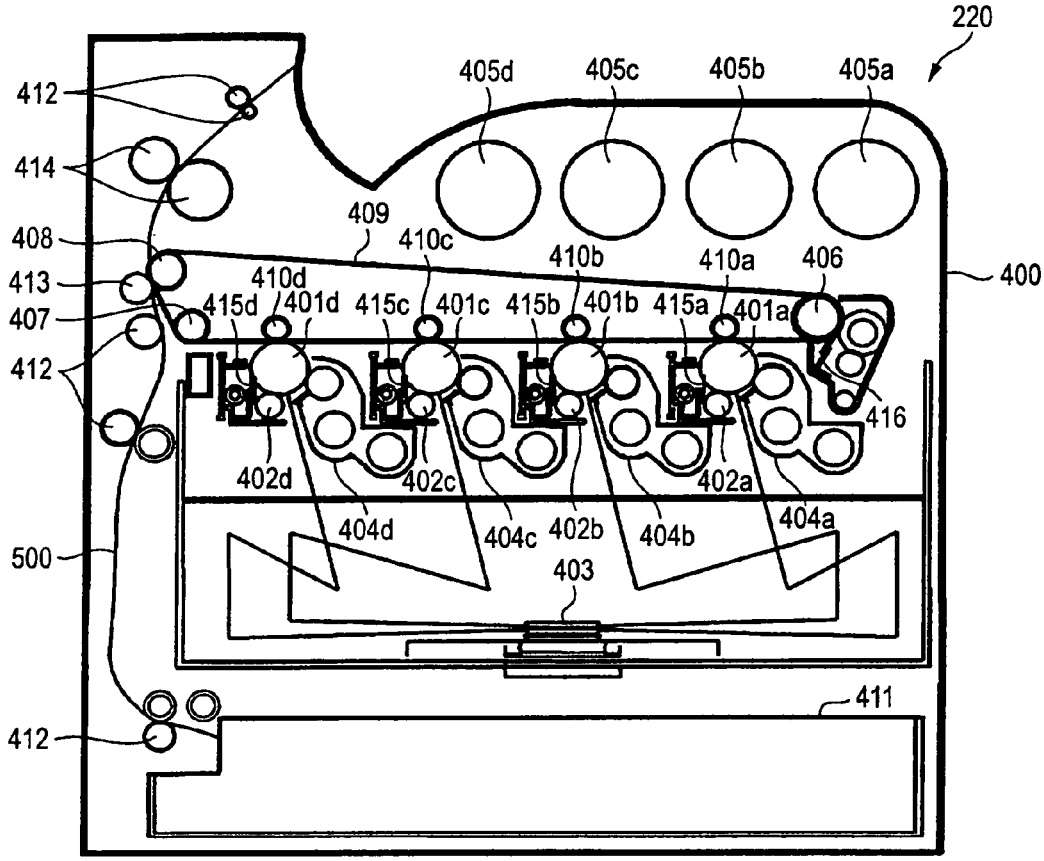
FIG. 5 is a schematic view showing another embodiment of an image forming apparatus of the invention.

FIG. 5 is a cross sectional view schematically showing a basic structure of another embodiment of the image forming apparatus of the invention. The image forming apparatus 220 shown in FIG. 5 is an image forming apparatus of an intermediate transfer system, and four electrophotographic photoreceptors 401*a* to 401*d* (for example, the electrophotographic photoreceptor 401*a* can form a yellow image, the electrophotographic photoreceptor 401*b* can form a magenta image, the electrophotographic photoreceptor 401*c* can form a cyan image, and the electrophotographic photoreceptor 401*d* can form a black image.) are arranged in parallel with each other along an intermediate transfer belt 409 in a housing 400. Here, the electrophotographic photoreceptors 401*a* to 401*d* carried by the image forming apparatus 220 are each the electrophotographic photoreceptors of the invention.

Each of the electrophotographic photoreceptors 401*a* to 401*d* is rotatable in a specified direction (counterclockwise on the sheet of FIG. 5), and charging rolls 402*a* to 402*d*, developing devices 404*a* to 404*d*, primary transfer rolls 410*a* to 410*d* and cleaning blades 415*a* to 415*d* are arranged along the rotational direction thereof. In each of the developing devices 404*a* to 404*d*, four-color toners of yellow (Y), magenta (M), cyan (C) and black (B) each contained in toner cartridges 405*a* to 405*d* can be supplied, and the primary transfer rolls 410*a* to 410*d* are each brought into abutting contact with the electrophotographic photoreceptors 401*a* to 401*d* through an intermediate transfer belt 409.

Further, a laser light source (exposure device) 403 is arranged at a specified position in the housing 400, and it is possible to irradiate surfaces of the electrophotographic photoreceptors 401*a* to 401*d* after charging with laser light emitted from the laser light source 403. This performs the respective steps of charging, exposure, development, primary transfer and cleaning in turn in the rotation step of the electrophotographic photoreceptors 401*a* to 401*d*, and toner images of the respective colors are transferred onto the intermediate transfer belt 409, one over another.

The intermediate transfer belt 409 is supported with a driving roll 406, a backup roll 408 and a tension roll 407 at a specified tension, and rotatable by the rotation of these rolls without the occurrence of deflection. Further, a secondary transfer roll 413 is arranged so that it is brought into abutting contact with the backup roll 408 through the intermediate transfer belt 409. The intermediate transfer belt 409 which has passed between the backup roll 408 and the secondary transfer roll 413 is cleaned up, for example, with a cleaning blade 416 arranged in the vicinity of the driving roll 406, and then repeatedly subjected to the subsequent image formation process.

Further, a tray (tray for a medium to which a toner image is to be transferred) 411 is provided at a specified position in the housing 400. The medium 500 to which the toner image is to be transferred (such as paper) in the tray 411 is conveyed in turn between the intermediate transfer belt 409 and the secondary transfer roll 413, and further between two fixing rolls 414 brought into abutting contact with each other, with a conveying roll 412, and then delivered out of the housing 400.

In the above, the description has been made for the case where the intermediate transfer belt 409 is used as an intermediate transfer body. However, the intermediate transfer body may be a belt-shaped one such as the above-mentioned intermediate transfer belt 409, or a drum-shaped one. When the belt-shaped structure such as the intermediate transfer belt 409 is employed as the intermediate transfer body, generally, the thickness of the belt is preferably from 50 to 500 μm, and more preferably from 60 to 150 μm. However, it can be appropriately selected depending on the hardness of the material. Further, when the structure having the drum shape is employed as the intermediate transfer body, it is preferred to use a cylindrical base material formed of aluminum, stainless steel (SUS), copper or the like as a base material. This cylindrical base material can be covered with an elastic layer as needed, and a surface layer can be formed on the elastic layer.

There is no particular limitation on the medium to which a toner image is to be transferred as used in the invention, as long as it is a medium to which the toner image formed on the electrophotographic photoreceptor is to be transferred. For example, the toner image is directly transferred from the electrophotographic photoreceptor to paper, the paper is the medium to which the toner image is to be transferred. When the intermediate transfer body is used, the intermediate transfer body is the medium to which the toner image is to be transferred.

Figure 6:
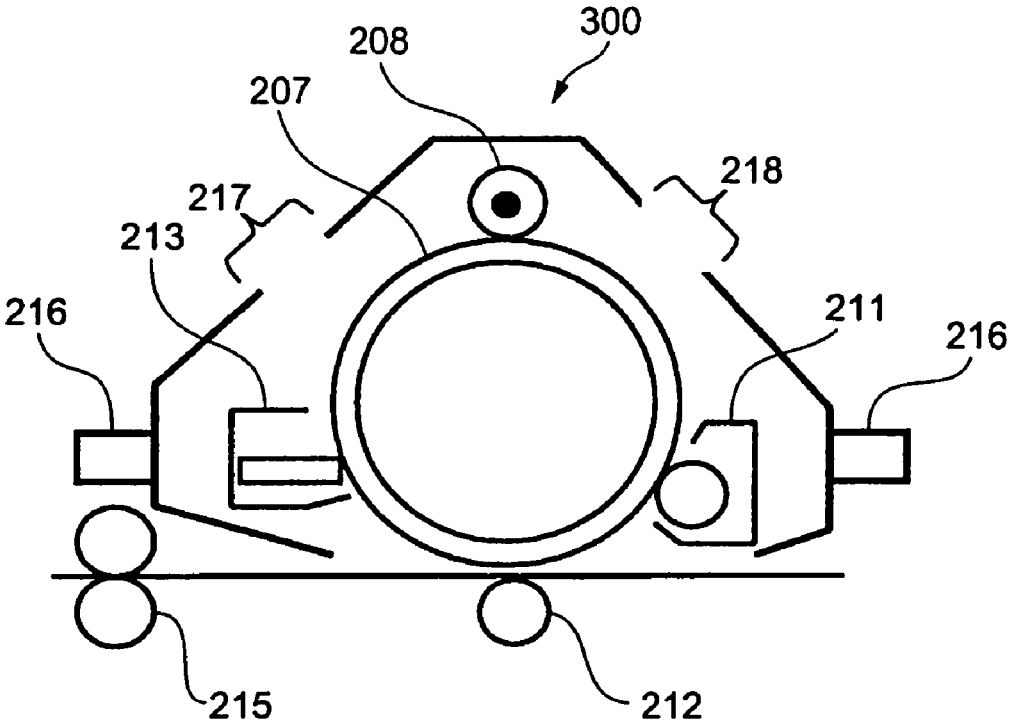
FIG. 6 is a schematic view showing a preferred embodiment of a process cartridge of the invention.

Further, FIG. 6 is a cross sectional view schematically showing a basic structure of a preferred embodiment of the process cartridge equipped with the electrophotographic photoreceptor of the invention. The process cartridge 300 is one fabricated by combining and integrating a charging device 208, a developing device 211, a cleaning device (cleaning unit) 213, an opening 218 for exposure and an opening 217 for static elimination exposure together with the electrophotographic photoreceptor 207, by using a attaching rail 216.

This process cartridge 300 can be easily put on and taken off from a main body of the image forming apparatus comprising a transfer device 212, a fixing device 215 and other constituent parts not shown, and constitutes the image forming apparatus together with the main body of the image forming apparatus.

In the image forming apparatus and process cartridge described above, the use of the electrophotographic photoreceptor of the invention excellent in electric characteristics and image characteristics can provide a high level of image quality.

EXAMPLES

The present invention will be illustrated in greater detail with reference to the following Examples and Comparative Example, but the invention should not be construed as being limited thereto. In the following Examples and Comparative Example, all the "parts" are given by weight unless otherwise indicated.

Example 1

An electrophotographic photoreceptor having a constitution similar to that of the electrophotographic photoreceptor 1 shown in FIG. 3 is prepared through the following procedure. A solution comprising 100 parts of a zirconium compound (trade name: Orgatics ZC540, manufactured by Matsumoto Chemical Industry Co., Ltd.), 10 parts of a silane compound (trade name: A110, manufactured by Nippon Unicar Co., Ltd.), 400 parts of isopropanol and 200 parts of butanol is applied by dip coating onto a cylindrical Al substrate subjected to honing treatment, and dried by heating at 150° C. for 10 minutes to form a 0.1-μm undercoating layer.

Then, as a charge generation material, 10 parts of chlorogallium phthalocyanine crystals having strong diffraction peaks at Bragg angles (2θ±0.2°) of 7.4°, 16.6°, 25.5° and 28.3° in an X-ray diffraction spectrum using CuKα radiation is mixed with 10 parts of a polyvinyl butyral resin (trade name: S-LEC BM-S, manufactured by Sekisui Chemical Co., Ltd.) and 1,000 parts of butyl acetate, and the resulting mixture is dispersed by treating it together with glass beads in a paint shaker for 1 hour to obtain a coating solution for a charge generation layer. The resulting coating solution is applied onto the undercoating layer by dip coating, and dried by heating at 100° C. for 10 minutes to form the charge generation layer having a film thickness of about 0.15 μm.

Further, 20 parts of a benzidine compound represented by the following structural formula (38), 30 parts of a bisphenol (Z) polycarbonate resin (viscosity average molecular weight: $4.4\times10^4$), 150 parts of monochlorobenzene and 150 parts of tetrahydrofuran are mixed to obtain a coating solution. The coating solution is applied onto the above-mentioned charge generation layer by dip coating, and dried by heating at 115° C. for 1 hour to form a 20-μm charge transport layer.

(38)

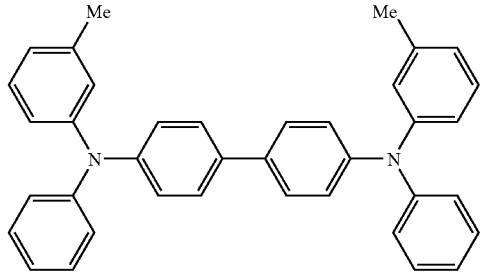

Further, 40 parts of exemplified compound (3-1) and 40 parts of exemplified compound (I-10) as components for forming a siloxane resin, 5 parts of a silane coupling agent (KBM-7402, manufactured by Shin-Etsu Chemical Co., Ltd.), and further 40 parts of methanol are collected and well mixed, and 5 parts of an ion exchange resin (AMBERLIST 15E, manufactured by Rhom & Hass Co.) is added thereto as a catalyst. After stirring for 2 hours, 100 parts of butanol and further 5 parts of distilled water are added thereto, followed by stirring at room temperature for 15 minutes. Then, the ion exchange resin is removed by filtration. Further, 1 part of aluminum trisacetylacetonate as a catalyst, 1 part of acetylacetone as a multidentate ligand, 5 parts of a polyvinyl butyral resin (trade name: S-LEC KW-1, manufactured by Sekisui Chemical Co., Ltd.) and 1 part of a hindered phenol antioxidant (trade name: SUMILIZER MDP-S, manufactured by Sumitomo Chemical Co., Ltd.) are added, and 10 parts of silica sol (trade name: R812, manufactured Aerosil Co., Ltd.) and 3 parts of fine fluorine particles (trade name: LUBRON L2, manufactured by Daikin Industries, Ltd.) are further added. The resulting mixture is dispersed together with glass beads in a paint shaker to obtain a coating solution for formation of a protective layer (a coating solution for formation of a siloxane resin-containing layer). This coating solution is applied onto the above-mentioned charge transport layer by dip coating (coating speed: about 170 mm/min), and dried by heating at 130° C. for 1 hour to form the 3-μm protective layer, thereby obtaining a desired electrophotographic photoreceptor.

Example 2

An undercoating layer, a charge generation layer and a charge transport layer are formed in the same manner as with Example 1. Then, the kinds and amounts compounded (parts) of components for forming a siloxane resin, polyvinyl butyral resin, fine particles, distilled water, catalyst, multidentate ligand and antioxidant are changed as shown in Table 2, and a 3-μm protective layer is formed on the charge transport layer in the same manner as with Example 1 to obtain a desired electrophotographic photoreceptor. In Example 2, the dispersing step is omitted. In Table 2, SUMILIZER BHT is a trade name of a hindered phenol antioxidant (manufactured by Sumitomo Chemical Co., Ltd.).

Example 3

An undercoating layer, a charge generation layer and a charge transport layer are formed in the same manner as with Example 1. Then, the kinds and amounts compounded (parts) of components for forming a siloxane resin, polyvinyl butyral resin, fine particles, distilled water, catalyst, multidentate ligand and antioxidant are changed as shown in Table 2, and a 3-μm protective layer is formed on the charge transport layer in the same manner as with Example 1 to obtain a desired electrophotographic photoreceptor.

Example 4

An undercoating layer, a charge generation layer and a charge transport layer are formed in the same manner as with Example 1. Then, 40 parts of exemplified compound (3-1) and 40 parts of exemplified compound (I-10) as components for forming a siloxane resin, 5 parts of a silane coupling agent (KBM-7402, manufactured by Shin-Etsu Chemical Co., Ltd.), and further 40 parts of methanol are collected and well mixed, and 5 parts of 1 N hydrochloric acid as a catalyst and further 5 parts of distilled water are added thereto, followed by stirring at room temperature for 15 minutes. Then, 5 parts of a polyvinyl butyral resin (trade name: S-LEC KW-1, manufactured by Sekisui Chemical Co., Ltd.) and 1 part of a hindered phenol antioxidant (trade name: SUMILIZER MDP-S, manufactured by Sumitomo Chemical Co., Ltd.) are added and dissolved therein to prepare a coating solution. The resulting solution is applied onto the above-mentioned charge transport layer by dip coating (coating speed: about 170 mm/min), and dried by heating at 130° C. for 1 hour to form a 3-μm protective layer, thereby obtaining a desired electrophotographic photoreceptor.

Example 5

An undercoating layer, a charge generation layer and a charge transport layer are formed in the same manner as with Example 1. Then, the kinds and amounts compounded (parts) of components for forming a siloxane resin, polyvinyl butyral resin, distilled water, catalyst, multidentate ligand and antioxidant are changed as shown in Table 2, and a 3-μm protective layer is formed on the charge transport layer in the same manner as with Example 1 to obtain a desired electrophotographic photoreceptor.

Example 6

An undercoating layer, a charge generation layer, a charge transport layer and a protective layer are formed in the same manner as with Example 1 with the exception that 10 parts of hydroxygallium phthalocyanine crystals having strong diffraction peaks at Bragg angles (2θ±0.2°) of 7.5°, 9.9°, 12.5°, 16.3°, 18.6°, 25.1° and 28.3° in an X-ray diffraction spectrum using CuKα radiation is used as the charge generation material, thereby obtaining a desired electrophotographic photoreceptor.

Example 7

A hundred parts of zinc oxide (trade name: SMZ-017N, manufactured by Tayca Corporation) is mixed with 500 parts of toluene by stirring, and 2 parts of a silane coupling agent (trade name: A1100, manufactured by Nippon Unicar Co., Ltd.) is further added, followed by stirring for 5 hours. Then, toluene is removed by distillation under reduced pressure, and baking is carried out at 120° C. for 2 hours. The resulting surface-treated zinc oxide is analyzed by fluorescent X-ray analysis. As a result, the Si element intensity is $1.8\times10^{-4}$ of the zinc element intensity.

Thirty-five parts of surface-treated zinc oxide, 15 parts of blocked isocyanate, a curing agent, (trade name: SUMIDULE 3175, manufactured by Sumitomo Bayer Urethane Co., Ltd.), 6 parts of a butyral resin (trade name: BM-1, manufactured by Sekisui Chemical Co., Ltd.) and 44 parts of methyl ethyl ketone are mixed, and dispersed by a sand mill using 1-mm-diameter glass beads for 2 hours to obtain a dispersion. Then, 0.005 part of dioctyltin dilaurate as a catalyst and 17 parts of silicone ball (trade name: TOSPEARL 130, manufactured by GE Toshiba Silicones Co., Ltd.) are added to the resulting dispersion to obtain a coating solution for formation of an undercoating layer. This coating solution is applied onto a drawn pipe base material (diameter: 84 mm, length: 347 mm) formed of JIS A3003 aluminum alloy by dip coating, and cured by drying at 160° C. for 100 minutes to obtain the undercoating layer having a film thickness of 20 μm. Then, a charge generation layer, a charge transport layer and a protective layer are formed in the same manner as with Example 1 to obtain a desired electrophotographic photoreceptor.

Example 8

An undercoating layer and a charge generation layer are formed in the same manner as with Example 1. Then, 40 parts of exemplified compound (3-1) and 20 parts of exemplified compound (I-10) as components for forming a siloxane resin, 50 parts of tetrahydrofuran, 30 parts of butanol and 30 parts of methanol are mixed, and 5 parts of an ion exchange resin (Amberlist 15E, manufactured by Rhom & Hass Co.) is added thereto as a catalyst. After stirring for 2 hours, 5 parts of distilled water is further added, followed by stirring at room temperature for 15 minutes. Then, the ion exchange resin is removed by filtration, and 20 parts of a polyvinyl butyral resin (trade name: S-LEC BXL (manufactured by Sekisui Chemical Co., Ltd.), 1 part of aluminum trisacetylacetonate, 1 part of acetylacetone and 1 part of a hindered phenol antioxidant (SUMILIZER MDP-S, manufactured by Sumitomo Chemical Co., Ltd.) are added to obtain a coating solution for a charge transport layer. The coating solution is applied onto the above-mentioned charge generation layer by dip coating, and dried by heating at 125° C. for 1 hour to form the charge transport layer, thereby obtaining a desired electrophotographic photoreceptor.

Comparative Example 1

An undercoating layer, a charge generation layer and a charge transport layer are formed in the same manner as with Example 1. Then, the kinds and amounts compounded (parts) of components for forming a siloxane resin are changed as shown in Table 2, and a 3-μm protective layer is formed on the charge transport layer in the same manner as with Example 1 to obtain a desired electrophotographic photoreceptor.

TABLE 2

| | Component for Forming Siloxane Resin | (parts) | Polyvinyl Butyral Resin | (parts) | Fine Particles | (parts) | Water (parts) | Catalyst |
|---|---|---|---|---|---|---|---|---|
| Ex. 1 | (3-1)<br>(I-10)<br>KBM 7402 | 40<br>40<br>5 | S-LEC<br>KW-1 | 5 | R812<br>Lubron<br>L2 | 10<br>3 | 5 | AMBERLIST<br>15E $Al(acac)_3$ |
| Ex. 2 | (3-1)<br>(I-10)<br>Hexamethyl cyclotrisiloxane | 40<br>30<br>10 | S-LEC<br>BXL | 5 | — | — | — | AMBERLIST<br>15E $Al(acac)_3$ |
| Ex. 3 | (3-1)<br>(I-10)<br>KBM 7402 | 40<br>45<br>5 | — | — | R812<br>Lubron<br>L2 | 10<br>3 | 5 | AMBERLIST<br>15E $Al(acac)_3$ |
| Ex. 4 | (3-1)<br>(I-10)<br>KBM 7402 | 40<br>40<br>5 | S-LEC<br>KW-1 | 5 | R812<br>Lubron<br>L2 | 10<br>3 | 5 | 1N<br>Hydrochloric<br>Acid |
| Ex. 5 | (3-1)<br>(I-10)<br>KBM 7402 | 40<br>45<br>5 | — | — | — | — | 5 | AMBERLIST<br>15E $Al(acac)_3$ |
| Comp. Ex. 1 | (3-1)<br>$Si(OMe)_4$<br>KBM 7402 | 40<br>45<br>5 | S-LEC<br>BXL | 5 | R812<br>Lubron<br>L2 | 10<br>3 | 5 | AMBERLIST<br>15E $Al(acac)_3$ |

| | (parts) | Multidentate Ligand | (parts) | Antioxidant | (parts) |
|---|---|---|---|---|---|
| Ex. 1 | 5 | Acetylacetone | 1 | SUMILIZER MDP-S | 1 |
| Ex. 2 | 5 | Diethyl malonate | 1 | SUMILIZER BHT | 1 |
| Ex. 3 | 5 | Acetylacetone | 1 | SUMILIZER MDP-S | 1 |
| Ex. 4 | 5 | — | — | SUMILIZER MDP-S | 1 |
| Ex. 5 | 5 | — | — | SUMILIZER MDP-S | 1 |
| Comp. Ex. 1 | 5 | Acetylacetone | 1 | SUMILIZER MDP-S | 1 |

Pot Life Evaluation Test of Coating Solution

The coating solution for formation of the protective layer used in each of Examples 1 to 8 and Comparative Example 1 is poured into a sample bottle, and the bottle is sealed hermetically. The time required from the time this sample bottle is maintained at a temperature of 40° C. until gelation, separation or precipitation occurred is measured, and the pot life of the coating solution is evaluated on the basis of the following criteria:

A: 20 days or more
B: From 10 days to less than 20 days
C: From 5 days to less than 10 days
D: From 2 days to less than 5 days
E: Less than 2 days
The results obtained are shown in Table 3.

As shown in Table 3, it is confirmed that the coating solutions for formation of the protective layers used in Examples 1 to 8 each had a sufficiently long pot life.

Print Test

Using the electrophotographic photoreceptors obtained in each of Examples 1 to 8 and Comparative Example 1, the image forming apparatus shown in FIG. 6 is fabricated. As elements other than the electrophotographic photoreceptor, ones similar to those of Docu Centre Color 400 CP (manufactured by Fuji Xerox Co., Ltd.) are used.

Then, using the resulting image forming apparatus, color print test by yellow (Y), magenta (M), cyan (C) and black (K) are carried out. The tests are carried out under 3 conditions; low temperature and low humidity (10° C. and 15% RH), normal temperature and normal humidity (20° C. and 40% RH) and high temperature and high humidity (30° C. and 85% RH), and the initial image quality and surface state of the electrophotographic photoreceptors, and the image quality and surface state of the electrophotographic photoreceptors after 5,000 prints are evaluated. Acid-free paper is used as print paper, and the tests are carried out in the order of normal temperature and normal humidity, low temperature and low humidity, and high temperature and high humidity. The surface state is evaluated for the respective electrophotographic photoreceptors of yellow (Y), magenta (M), cyan (C) and black (K) on the basis of the following criteria:

A: Neither a scratch nor a deposit is observed.

B: Scratches or deposits are slightly observed (observable under a microscope).

C: Scratches or deposits are slightly observed (observable through a magnifier).

D: Scratches or deposits are observed (observable by naked eyes).

E: Scratches or deposits are significantly observed (observable by naked eyes).

The results obtained are shown in Table 3.

TABLE 3

| | | Image Quality | | | | | | Surface of Photoreceptor | | | | | | | | | | | | |
|---|---|---|---|---|---|---|---|---|---|---|---|---|---|---|---|---|---|---|---|---|
| | | Initial | | | After 5,000 Prints | | | | After 5,000 Prints | | | | | | | | | | | |
| | | | | | | | | | Normal Temp. and Normal Humidity | | | | Low Temp. and Low Humidity | | | | High Temp. and High Humidity | | | |
| | Pot Life | Low Temp. and Low Humidity | Normal Temp. and Normal Humidity | High Temp. and High Humidity | Low Temp. and Low Humidity | Normal Temp. and Normal Humidity | High Temp. and High Humidity | Initial | Y | M | C | K | Y | M | C | K | Y | M | C | K |
| Ex. 1 | A | Good | Good | Good | Good | Good | Good | A | A | A | A | A | A | A | A | A | A | A | A | A |
| Ex. 2 | A | Good | Good | Good | Good | Good | Good | A | A | A | A | A | A | A | A | A | A | A | A | A |
| Ex. 3 | A | Good | Good | Good | Good | Good | Good | A | A | A | A | A | A | A | A | B | B | A | A | B |
| Ex. 4 | C | Good | Good | Good | Good | Good | Good | A | A | A | A | A | A | A | A | A | A | A | A | A |
| Ex. 5 | B | Good | Good | Good | Good | Good | Good | A | A | A | A | A | A | A | A | B | B | A | B | B |
| Ex. 6 | A | Good | Good | Good | Good | Good | Good | A | A | A | A | A | A | A | A | A | A | A | A | A |
| Ex. 7 | A | Good | Good | Good | Good | Good | Good | A | A | A | A | A | A | A | A | A | A | A | A | A |
| Ex. 8 | C | Good | Good | Good | Good | Good | Good | A | A | A | A | B | B | B | A | B | B | B | B | B |
| Comp. Ex. 1 | A | Good | Good | Good | Streaks are observed | Streaks are observed | Streaks are observed | A | C | C | C | C | D | D | D | C | E | E | E | D |

As shown in FIG. 3, in the case of the image forming apparatus carrying the electrophotographic photoreceptors of Examples 1 to 8, it is confirmed that the image quality and the surface state of the photoreceptors are good even after 50,000,000 prints.

As described above, according to the invention, there can be provided the electrophotographic photoreceptor which is sufficiently high in stain resistance against a developing agent, a discharge product, etc. and in durability against a contact charger, a cleaning blade, etc.; and the image forming apparatus and process cartridge which can provide good image quality for a long period of time.

While the present invention has been described in detail with reference to specific embodiments thereof, it will be apparent to one skilled in the art that various changes and modifications can be made therein without departing from the spirit and scope thereof.

What is claimed is:

1. An electrophotographic photoreceptor comprising a conductive support having formed thereon a photosensitive layer, wherein the photosensitive layer comprises a siloxane resin-containing layer containing a siloxane resin having a structural unit represented by general formula (1) shown below, a structural unit represented by general formula (2) shown below, and an organic group derived from a compound having hole transport capability:

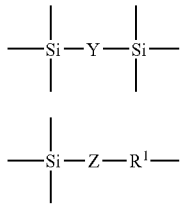

(1)

(2)

wherein, in formula (1), Y represents a divalent group containing at least one carbon atom in its main chain, and in formula (2), $R^1$ represents an alkylene group, and Z represents an oxygen atom, a sulfur atom or NH, and wherein the divalent group is at least one selected from a group consisting of $—C_nH_{2n}—$, $—C_nH_{2n-2}—$, $—C_nH_{2n-4}—$, $—C_6H_4—$, $—C_6H_4—C_6H_4—$, —NH—, $—C_nF_{2n}—$, —COO—, —S—, —O— and —N═CH—, wherein n represents an integer of 1 to 15, provided that when a divalent group containing —S—, —NH— and —O— is used for Y, such a group is used in combination with a group containing a carbon atom to constitute a divalent group containing at least one carbon atom in its main chain.

2. An image forming apparatus comprising:

an electrophotographic photoreceptor according to claim 1;

a charging device for charging the electrophotographic photoreceptor;

an exposing device for exposing the charged electrophotographic photoreceptor to form an electrostatic latent image;

a developing device for developing the electrostatic latent image to form a toner image; and a transfer device for transferring the toner image to a medium to which the toner image is to be transferred.

3. A process cartridge comprising:

an electrophotographic photoreceptor according to claim 1; and at least one member selected from the group consisting of a charging device for charging an electrophotographic photoreceptor, an exposing device for exposing a charged electrophotographic photoreceptor to form an electrostatic latent image, and a cleaning device for cleaning an electrophotographic photoreceptor.

4. An electrophotographic photoreceptor comprising a conductive support having formed thereon a photosensitive layer, wherein the photosensitive layer comprises a siloxane resin-containing layer containing a siloxane resin obtained by using an organic silicon compound having a structural unit represented by general formula (1) shown below and a hydrolytic group, and a compound represented by general formula (3) shown below:

(1)

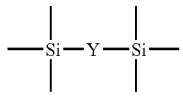

(3)

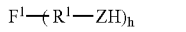

wherein, in formula (1), Y represents a divalent group containing at least one carbon atom in its main chain, and in formula (3), $F^1$ represents an organic group derived from a compound having hole transport capability, $R^1$ represents an alkylene group, Z represents an oxygen atom, a sulfur atom or NH, and h represents an integer of 1 to 4, and wherein the divalent group is at least one selected from a group consisting of $—C_nH_{2n}—$, $—C_nH_{2n-2}—$, $—C_nH_{2n-4}—$, $—C_6H_4—$, $—C_6H_4—C_6H_4—$, —NH—, $—C_nF_{2n}—$, —COO—, —S—, —O— and —N═CH—, wherein n represents an integer of 1 to 15, provided that when a divalent group containing —S—, —NH— and —O— is used for Y, such a group is used in combination with a group containing a carbon atom to constitute a divalent group containing at least one carbon atom in its main chain.

5. A method for producing an electrophotographic photoreceptor comprising a conductive support having formed thereon a photosensitive layer containing a siloxane resin-containing layer, which comprises:

a coating solution preparing step of preparing a coating solution for formation of a siloxane resin-containing layer using an organic silicon compound having a structural unit represented by general formula (1) shown below and a hydrolytic group, and a compound represented by general formula (3) shown below; and a siloxane resin-containing layer forming step of forming the siloxane resin-containing layer using the coating solution:

(1)

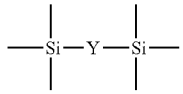

(3)

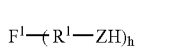

wherein, in formula (1), Y represents a divalent group containing at least one carbon atom in its main chain, and in formula (3), $F^1$ represents an organic group derived from a compound having hole transport capability, $R^1$ represents an alkylene group, Z represents an oxygen atom, a sulfur atom or NH, and h represents an integer of 1 to 4, and wherein the divalent group is at least one selected from a group consisting of $—C_nH_{2n}—$, $—C_nH_{2n-2}—$, $—C_nH_{2n-4}—$, $—C_6H_4—$, $—C_6H_4—C_6H_4—$, —NH—, $—C_nF_{2n}—$, —COO—, —S—, —O— and —N═CH—, wherein n represents an integer of 1 to 15, provided that when a divalent group containing —S—, —NH— and —O— is used for Y, such a group is used in combination with a group containing a carbon atom to constitute a divalent group containing at least one carbon atom in its main chain.

6. The method according to claim 5, wherein the coating solution contains a metal chelate compound.

7. The method according to claim 6, wherein the metal chelate compound is an organic aluminum compound.

8. The method according to claim 6, wherein the coating solution contains a multidentate ligand.

9. The method according to claim 5, wherein the coating solution contains a multidentate ligand.

10. The method according to claim 9, wherein the multidentate ligand is represented by the following general formula (37):

(37)

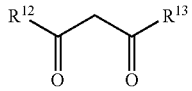

wherein $R^{12}$ and $R^{13}$ each independently represents an alkyl or fluorinated alkyl group having 1 to 10 carbon atoms or an alkoxyl group having 1 to 10 carbon atoms.

* * * * *